US009811975B2

(12) United States Patent
Gilbertson et al.

(10) Patent No.: US 9,811,975 B2
(45) Date of Patent: Nov. 7, 2017

(54) METHODS AND APPARATUSES FOR ELECTRONIC GAMING INCLUDING STACKS AND BLOCKS OF SYMBOLS

(71) Applicant: SG Gaming ANZ Pty Ltd, Silverwater (AU)

(72) Inventors: Ross M. Gilbertson, Ultimo (AU); Jack Chesworth, Las Vegas, NV (US); Daniel Wilby, Surry Hills (AU); Gary Huang, South Coogee (AU)

(73) Assignee: SG Gaming ANZ Pty Ltd, Silverwater (AU)

( * ) Notice: Subject to any disclaimer, the term of this patent is extended or adjusted under 35 U.S.C. 154(b) by 594 days.

(21) Appl. No.: 14/033,038

(22) Filed: Sep. 20, 2013

(65) Prior Publication Data

US 2015/0087382 A1 Mar. 26, 2015

(51) Int. Cl.
*G07F 17/32* (2006.01)

(52) U.S. Cl.
CPC ..... *G07F 17/326* (2013.01)

(58) Field of Classification Search
CPC ..... G07F 17/34; G07F 17/326; G07F 17/3265
See application file for complete search history.

(56) References Cited

U.S. PATENT DOCUMENTS 4,198,052 A 4/1980 Gauselmann
5,584,764 A * 12/1996 Inoue ..... G07F 17/34 273/143 R
6,190,254 B1 2/2001 Bennett
6,261,178 B1 7/2001 Bennett
6,471,208 B2 10/2002 Yoseloff et al.
6,652,378 B2 11/2003 Cannon et al.
6,656,046 B1 12/2003 Yoseloff et al.
6,869,360 B2 3/2005 Marks et al.
7,347,777 B2 3/2008 Gauselmann
D603,459 S 11/2009 Tsuchida et al.
(Continued)

FOREIGN PATENT DOCUMENTS

AU 721968 7/2000
GB 2097160 A 5/1984

OTHER PUBLICATIONS

Mid & high denom games, "Pot of Gold" IGT double diamond, accessed prior to Aug. 19, 2013, 1 page.

*Primary Examiner* — Jasson Yoo
(74) *Attorney, Agent, or Firm* — TraskBritt

(57) ABSTRACT

Methods and apparatuses for a wagering game include displaying an electronic reel simulation as a multiple reel array on a display. A game outcome is determined and presented as game symbols on the display. Before a game play and without player input, block arrangements are defined as stacks of a same size within the array, each stack has adjacent positions along a first direction within the array, each stack occupies a different position within the array in a second direction perpendicular to the first direction, and all of the stacks are aligned in the second direction. Winning combinations of the symbols are determined as two or more matching symbols appearing in the displayed positions in combinations of payout ways predefined before the game play. Winning blocks are determined wherein each of the one or more winning blocks include matching symbols appearing in displayed positions corresponding with the block arrangements.

38 Claims, 32 Drawing Sheets

(56) References Cited

U.S. PATENT DOCUMENTS

| | | | | |
|---|---|---|---|---|
| D603,460 | S | 11/2009 | Taniguchi | |
| D642,224 | S | 7/2011 | Taniguchi | |
| 8,137,179 | B2 | 3/2012 | Jensen et al. | |
| 8,287,358 | B2 | 10/2012 | Aoki | |
| 2002/0045482 | A1* | 4/2002 | Poole | G07F 17/3227 463/31 |
| 2002/0142829 | A1 | 10/2002 | Inoue | |
| 2004/0121836 | A1* | 6/2004 | Rudolph | G07F 17/3265 463/20 |
| 2007/0082728 | A1* | 4/2007 | Wilkins | G07F 17/32 463/22 |
| 2007/0087805 | A1 | 4/2007 | Taylor | |
| 2008/0076513 | A1 | 3/2008 | Esses et al. | |
| 2009/0048013 | A1 | 2/2009 | Castellari | |
| 2009/0117978 | A1 | 5/2009 | Dias Pires | |
| 2009/0124347 | A1* | 5/2009 | Rodgers | G07F 17/34 463/21 |
| 2009/0156287 | A1 | 6/2009 | Baumgartner | |
| 2011/0294560 | A1 | 12/2011 | Carlson et al. | |
| 2012/0034965 | A1 | 2/2012 | Masen et al. | |
| 2013/0084942 | A1 | 4/2013 | Kelly et al. | |
| 2014/0274288 | A1* | 9/2014 | Hornik | G07F 17/34 463/20 |

* cited by examiner

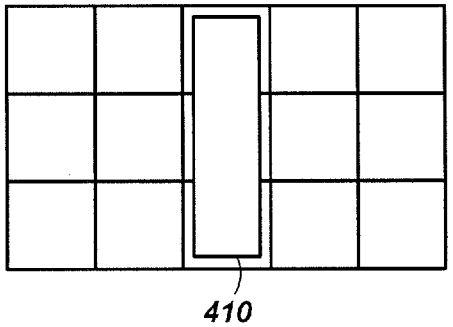
FIG. 4A
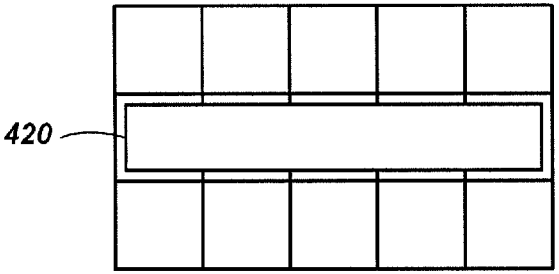
FIG. 4B
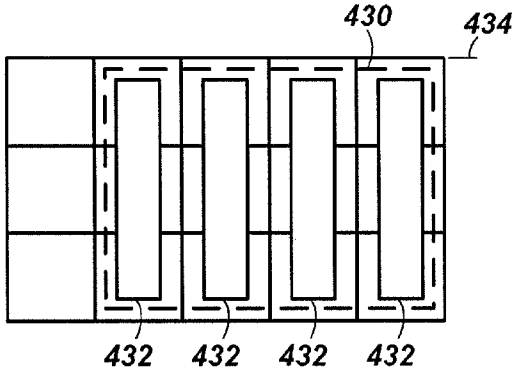
FIG. 4C
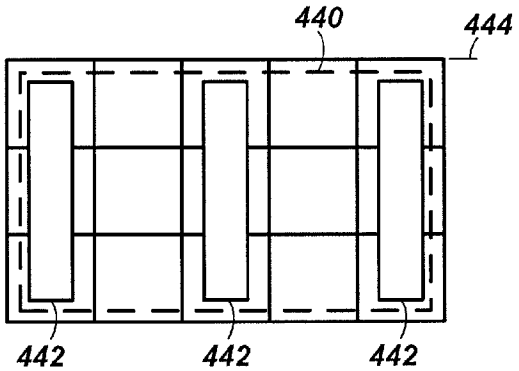
FIG. 4D
FIG. 4E
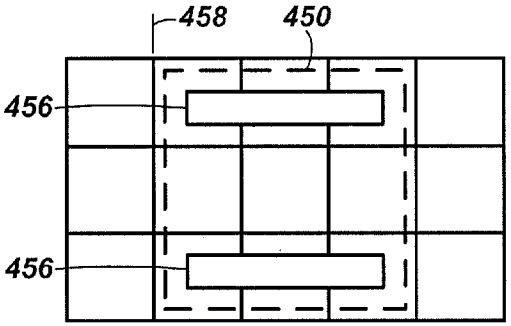
FIG. 4F

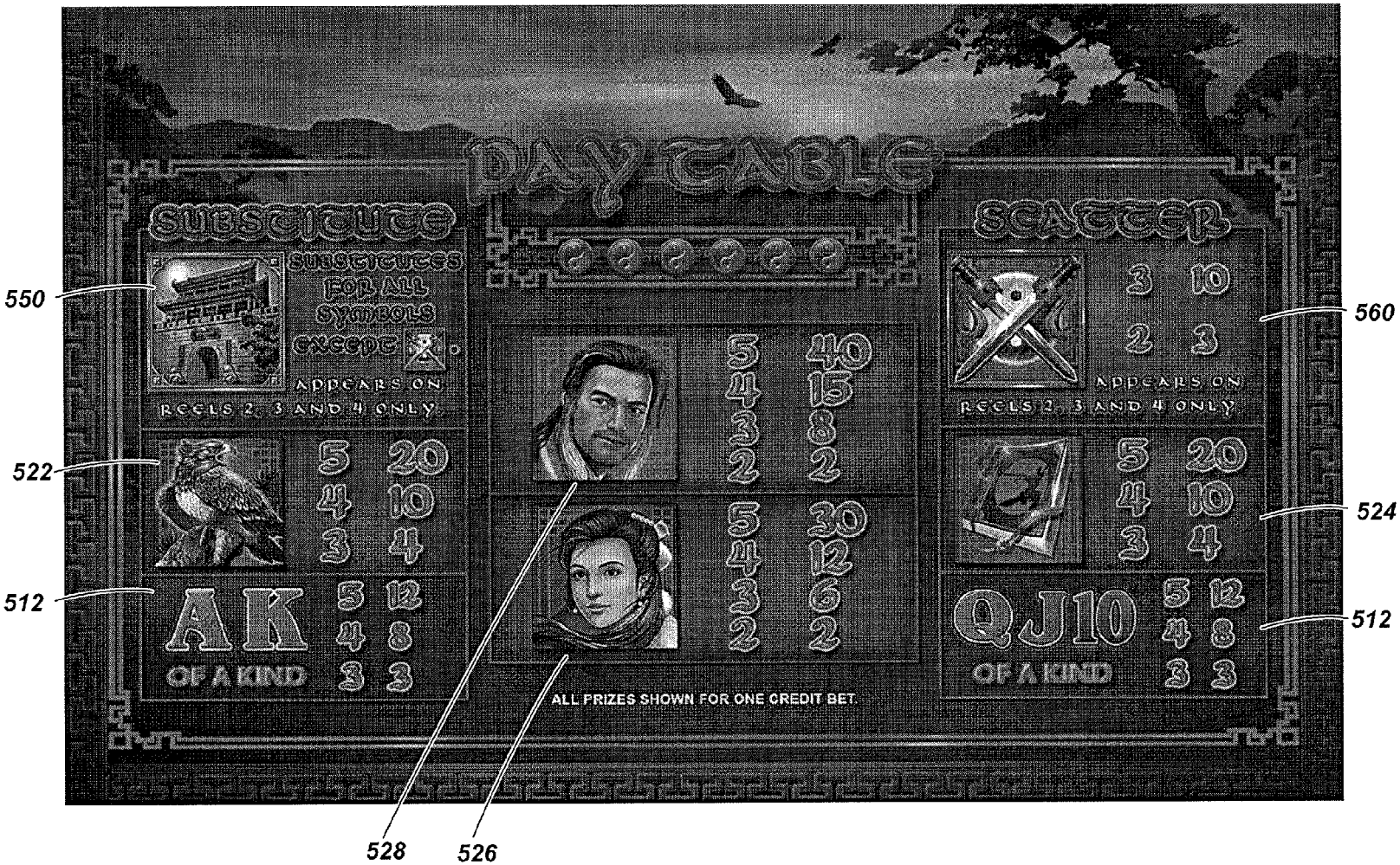
560
524
512
550
522
512
526
528
SUBSCRIBE
SUBSCRIBE
SUBSCRIBE

2010

METHODS AND APPARATUSES FOR ELECTRONIC GAMING INCLUDING STACKS AND BLOCKS OF SYMBOLS

TECHNICAL FIELD

This invention relates to wagering games and payout systems for electronic gaming systems to electronic gaming systems configured for administering such wagering games and payout systems, and to methods of administering such wagering games and payout systems.

BACKGROUND

The following discussion of the background art is intended to facilitate an understanding of the present disclosure only. It should be appreciated that the discussion is not an acknowledgement or admission that any of the material referred to was part of the common general knowledge as of the priority date of the application.

Players who regularly play gaming machines tire of particular games as the entertainment factor or winning opportunities reduce or become staid. Therefore, it has become necessary for manufacturers of these machines to develop innovative games that differ from previous types of games and have variety and bonuses in the form of features or jackpot awards that add interest to the games. In so doing, it is hoped to keep players entertained and, therefore, interested in continuing to play the game, as well as attract new players to the game.

With the growth that has occurred in the gaming machine market, there is intense competition between manufacturers to supply gaming machines to venues that provide for the playing of these machines. When selecting a supplier of gaming machines, the operator of a venue will usually pay close attention to the popularity of various games played by their patrons. Therefore, gaming machine manufacturers are continually devising new games and/or bonuses that are popular with players in order to improve sales, retain customers and attract new customers.

One form of gaming machine that has proven to be particularly popular over the years has been the spinning reel machine. These types of machines have now evolved into displaying a number of simulated, or "virtual," reels displayed on video display systems having various symbols displayed at prescribed locations on the reels. Each reel has a prescribed number of positions that correspond to positions in an array whereby the position and sequence in the array may be represented by a symbol bearing some distinctive value in a sequence of symbols in paylines or generally distributed on the game display of the same or predefined type.

The individual reels are simulated to rotate during a play, and stop in a position that may be required to be positioned relative to a predefined pattern within the video display to show one or more rows of symbols, paylines or random distributions from adjacent reels or the totality of reels in a window or in a virtual display. In this manner, the reels are usually aligned to form a regular matrix of rows and columns of symbols that are displayed to the player for analysis of winning or losing events by the player or a processor associated with an electronic gaming machine.

A common window configuration is a matrix of three rows and five columns, but other combinations may also be used. By virtue of adopting a regular matrix, it has become common to adopt one or more paylines that are defined across the matrix and can be displayed in the window, for example, the center row, the top row, the bottom row, (all horizontal) and possibly one or more meander lines (e.g., non-straight or zig-zag lines). A payline identifies the particular combination of positions at which symbols are located within the matrix, extending logically across the columns and through rows, which is considered for determining whether the outcome is a winning outcome.

The player may select (by wagering or purchasing) one or more paylines per game. The paylines are normally automatically selected by a processor in a fixed sequence. For example, if the player selects one payline, this will normally be the central horizontal line. Similarly, selecting two paylines will activate the center payline and the top horizontal payline. The player may also select the amount wagered per line. A payline is active if the player has wagered sufficient amounts of credits or value so that a sufficient amount activates paylines to include a particular payline or specifically selected individual paylines or groups of paylines. Paylines that are not active are inactive.

Multiple line games, as well as for providing an easy means of delivering linearity (i.e., ensuring that the probability of winning is maintained proportional to the credits bet per play), also allow the player to choose the particular level of volatility they desire. This provides greater utility for the one game appealing to players who prefer different levels of volatility by choosing the number of paylines they wish to play with.

Games are precisely designed mathematically to provide a prescribed paytable that achieves a return to player requirement that complies with gaming regulations mandated for a particular jurisdiction. Consequently, it is a constant challenge for gaming machine manufacturers to come up with new games that appeal to players that may satisfy their variable need for volatility and provide an entertainment experience.

Accordingly, gaming machine manufacturers are continually designing new and innovative combinations of games and payout schemes that have more appeal to players than others in order to add to the sales appeal of a particular gaming machine.

SUMMARY

Embodiments of the present disclosure include a computer implemented method of administering game play. The method includes displaying an electronic reel simulation of a wagering game on a game display of an electronic gaming machine, the electronic reel simulation including a multiple reel array. The method also includes determining a game outcome and causing the game outcome to be presented on the game display, the game outcome comprising a plurality of symbols for an array of displayed positions of the multiple reel array. Before a game play and without player input, one or more block arrangements are defined, wherein each block arrangement comprises two or more stacks of a same size within the array, each stack comprises two or more adjacent positions along a first direction within the array, each stack occupies a different position within the array in a second direction perpendicular to the first direction, and all of the two or more stacks are aligned in the second direction. One or more winning combinations of the symbols are determined wherein each winning combination comprises two or more matching symbols appearing in the displayed positions in combinations of payout ways predefined before the game play. One or more winning blocks are determined wherein each of the one or more winning blocks comprise matching symbols appearing in displayed positions corresponding with the one or more block arrangements.

Embodiments of the present disclosure also include a gaming system comprising a game display and processing circuitry operably coupled to the game display. The processing circuitry is configured to cause the gaming system to display an electronic reel simulation of a wagering game on the game display, the electronic reel simulation including a multiple reel array. The processing circuitry also causes the game system to determine a game outcome and cause the game outcome to be presented on the game display, the game outcome comprising a plurality of symbols for an array of displayed positions of the multiple reel array. Before a game play and without player input, the processing circuitry also causes the game system to determine one or more block arrangements, wherein each block arrangement comprises two or more stacks of a same size within the array, each stack comprises two or more adjacent positions along a first direction within the array, each stack occupies a different position within the array in a second direction perpendicular to the first direction, and all of the two or more stacks are aligned in the second direction. The processing circuitry also causes the game system to determine any winning combinations of the symbols, wherein each winning combination comprises two or more matching symbols appearing in the displayed positions in combinations of payout ways predefined before the game play. The processing circuitry also causes the game system to determine one or more winning blocks, wherein each of the one or more winning blocks comprise matching symbols appearing in displayed positions corresponding with the one or more block arrangements.

Other embodiments of the present disclosure include a computer implemented method of administering game play. The method includes displaying an electronic reel simulation of a wagering game on a game display of a gaming system, the electronic reel simulation including a multiple reel array. The method also includes determining a game outcome and causing the game outcome to be presented on the game display, the game outcome comprising a plurality of symbols for an array of displayed positions of the multiple reel array. The method also includes randomly applying one or more stack frames to at least one reel of the multiple reel array, wherein each stack frame comprises three or more matching symbols that appear in adjacent symbol positions on the at least one reel. The method also includes determining a winning combination for the game outcome, wherein the winning combination comprises three or more reels of matching symbols appearing in the displayed positions; and jackpot award is triggered for the one or more stack frames.

Still other embodiments of the present disclosure include a gaming system comprising a game display and processing circuitry operably coupled to the game display. The processing circuitry causes the game system to display an electronic reel simulation of a wagering game on the game display, the electronic reel simulation including a multiple reel array. The processing circuitry also causes the game system to determine a game outcome and cause the game outcome to be presented on the game display, the game outcome comprising a plurality of symbols for an array of displayed positions of the multiple reel array. The processing circuitry also causes the game system to randomly apply one or more stack frames to at least one reel of the multiple reel array, wherein each stack frame comprises three or more matching symbols that appear in adjacent symbol positions on the at least one reel. The processing circuitry also causes the game system to determine one or more winning combinations for the game outcome, wherein the winning combinations comprise three or more reels of matching symbols appearing in the displayed positions, and trigger a jackpot award for the one or more stack frames.

BRIEF DESCRIPTION OF THE DRAWINGS

The invention is described with reference to the following drawings of different specific embodiments of a mode for carrying out the invention, wherein:

FIGS. 4A-4F show various arrangements of stacks and block arrangements in an array of displayed positions;

FIG. 5 shows a game display illustrating a paytable for an embodiment of the present disclosure;

DETAILED DESCRIPTION

Figure 1:
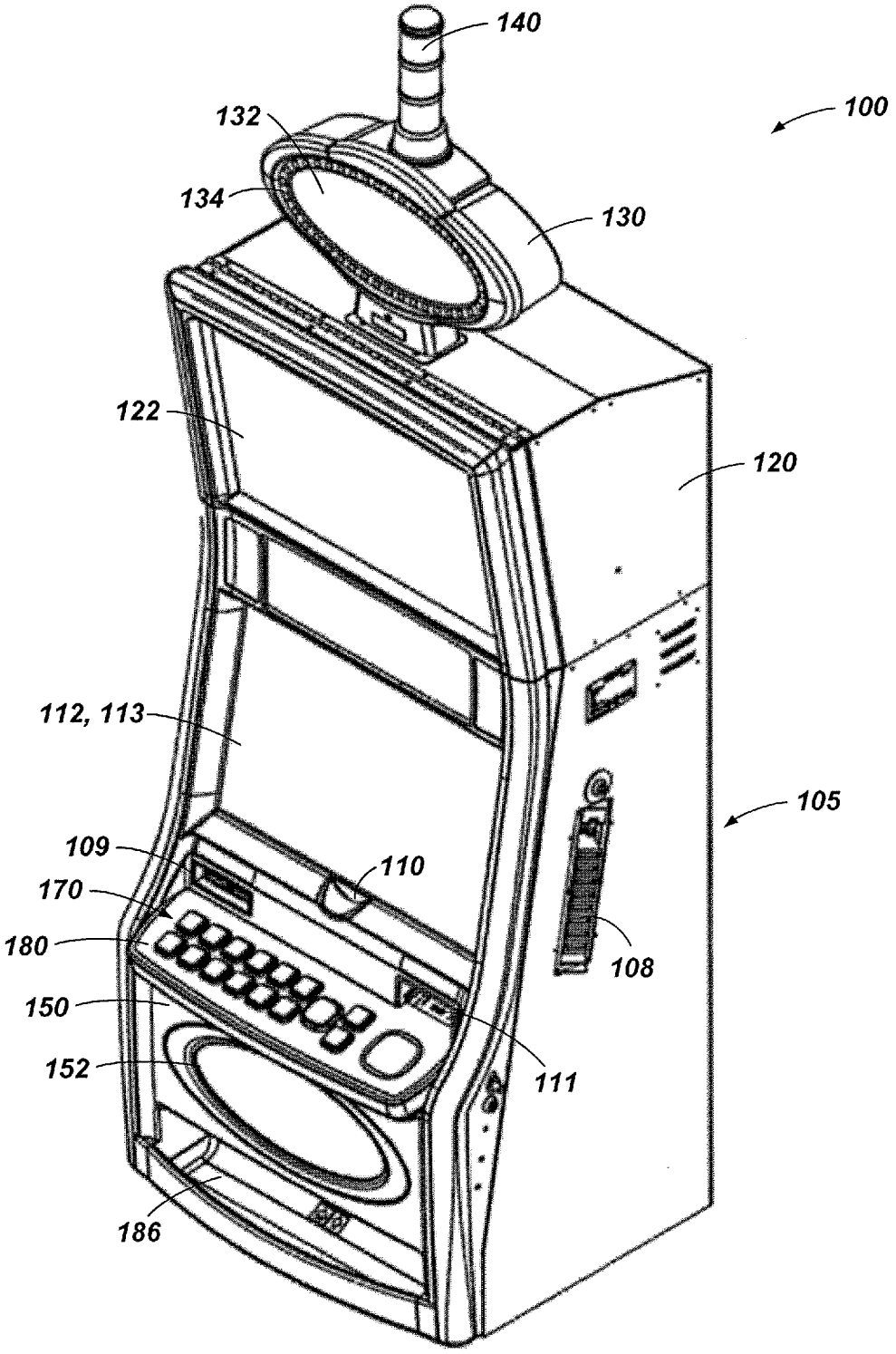
FIG. 1 depicts an electronic gaming machine suitable for the embodiments of the present disclosure.

In the following detailed description, reference is made to the accompanying drawings which form a part hereof, and in which is shown by way of illustration specific embodiments in which the invention may be practiced. These embodiments are described in sufficient detail to enable those of ordinary skill in the art to practice the invention. It should be understood, however, that the detailed description and the specific examples, while indicating examples of embodiments of the invention, are given by way of illustration only and not by way of limitation. From this disclosure, various substitutions, modifications, additions rearrangements, or combinations thereof within the scope of the present invention may be made and will become apparent to those of ordinary skill in the art.

In accordance with common practice the various features illustrated in the drawings may not be drawn to scale. The illustrations presented herein are not meant to be actual views of any particular method, device, or system, but are merely idealized representations that are employed to describe various embodiments. Accordingly, the dimensions of the various features may be arbitrarily expanded or reduced for clarity. In addition, some of the drawings may be simplified for clarity. Thus, the drawings may not depict all of the components of a given apparatus (e.g., device) or method. In addition, like reference numerals may be used to denote like features throughout the specification and figures.

Those of ordinary skill would appreciate that the various illustrative logical blocks, modules, circuits, and algorithm acts described in connection with embodiments disclosed herein may be implemented as electronic hardware, computer software, or combinations of both. To clearly illustrate this interchangeability of hardware and software, various illustrative components, blocks, modules, circuits, and acts are described generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the embodiments described herein.

In addition, it is noted that the embodiments may be described in terms of an algorithm, a process, or a combination thereof that is depicted as a flowchart, a flow diagram, a structure diagram, or a block diagram. Although a flowchart may describe operational acts as a sequential process, many of these acts can be performed in another sequence, in parallel, or substantially concurrently. In addition, the order of the acts may be re-arranged. A process may correspond to a method, a function, a procedure, a subroutine, a subprogram, etc. Furthermore, the methods disclosed herein may be implemented in hardware, software, or both. If implemented in software, the functions may be stored or transmitted as one or more instructions or code on a computer-readable medium. Computer-readable media includes both computer storage media and communication media including any medium that facilitates transfer of a computer program from one place to another.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. Also, unless stated otherwise a set of elements may comprise one or more elements.

A mode for carrying out embodiments described herein will be described with reference to a gaming system being programmed and configured to implement one or more different wagering games. Several specific embodiments of games designed in accordance with the embodiments will be subsequently described as part of the mode.

Embodiments of the present disclosure are applicable, although not exclusively, to gaming systems that have one or more bonus symbols included with other symbols in an array of symbols that are to be displayed on a video screen and, where prescribed, sets of these symbols are randomly selected from the array and displayed in a matrix as a result of a play.

Figure 2:
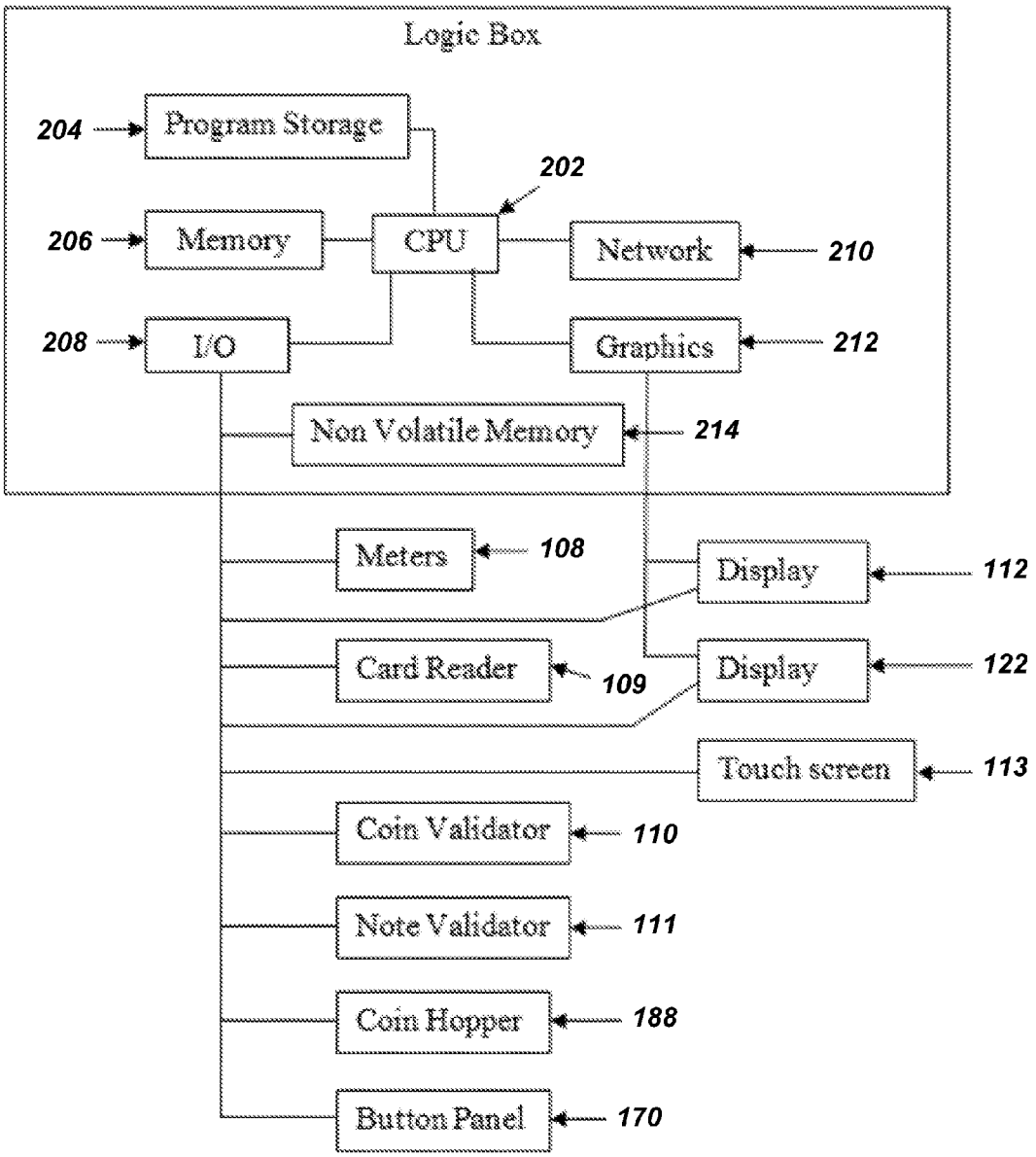
FIG. 2 is a functional block diagram showing some of the functional elements of the electronic gaming machine of FIG. 1.

FIG. 1 depicts an electronic gaming machine 100 suitable for embodiments of the present disclosure. The electronic gaming machine 100 may also be referred to herein simply as a gaming machine 100. FIG. 2 is a functional block diagram showing some of the functional elements of the gaming machine 100 of FIG. 1. The gaming machine 100 is a stand-alone machine as one example embodiment of a gaming system for practicing the present disclosure. As another example, the present disclosure may be practice in a gaming system including a distributed system such as a client-server type system as explained below with reference to FIGS. 31 and 32.

Referring to FIGS. 1 and 2, the gaming machine 100 includes a main cabinet 105 for housing and supporting the various components required to operate a game on the gaming machine 100. The design of the main cabinet 105 as illustrated in FIG. 1 is referred to in the industry as a "slant-top" cabinet and may be positioned on a base or stand (not shown) to allow a player to operate the gaming machine 100 in either a standing or sitting position. The main cabinet 105 includes a primary display 112 used to display a game. The gaming machine 100 also includes a top box 120 containing a secondary display 122. While the top box 120 is not an essential component of the gaming machine 100, it is frequently included to provide extra display space to present additional information, advertising, or features related to the game. As such, the top box 120 may be separately attached or integral to the main cabinet 105. It should also be appreciated that the primary display 112 and secondary display 122 can be formed from a single elongate display unit.

The primary and secondary displays 112, 122 as depicted in FIG. 1 may be video display units. More particularly, the video display units may be liquid crystal display (LCD) monitors. Other types of video display are also applicable, including, but not limited to, cathode ray tube (CRT) monitors, plasma displays, light emitting diode (LED) displays, projection displays, and electroluminescent panels. A mechanical reel mechanism and static display may also be used for the primary and secondary displays 112, 122 respectively.

A marquee 130 is mounted to the top box 120 to attract the attention of players to the gaming machine 100. The marquee 130 includes a static display in the form of a panel 132. The panel 132 may be made from a transparent or translucent sheet material (e.g., glass, acrylic, PERSPEX®, etc.) and may include printed artwork relating to the particular game provided on the gaming machine 100. The panel 132 may be backlit by an internal light source (not shown) provided in the marquee 130. The marquee 130 may also include an array of light emitting diodes 134 bordering the periphery of the panel 132, which may be controlled to flash in various sequences as a further means of attracting attention to the gaming machine 100. The marquee 130 may also include a light tower 140, otherwise referred to as a "candle 140," which may be controlled to flash in a particular way to indicate a particular state or condition of the gaming machine 100. For example, the candle 140 may flash in a specific sequence when a door 150 of the main cabinet 105 is opened as a means of warning floor staff of the gaming establishment of potential tampering with the gaming machine 100. In alternative embodiments, the candle 140 may be directly mounted to the top box 120 or main cabinet 105.

As shown in FIG. 1, a panel 152 may also be included in the door 150 of the main cabinet 105. In this case, artwork printed on the panel 152 is backlit by an internal light source provided in the main cabinet 105. In alternative embodiments, panels 132, 152 may be provided as video displays.

A user interface in the form of an electromechanical button panel 170 is included on a console 180 of the main cabinet 105 to allow players to interact with the gaming machine 100. The button panel 170 may include one or more buttons useful in the play of a particular game or games provided on the gaming machine 100. For example, the button panel 170 may include buttons to allow the player to select from a range of available playing and betting options, spin the reels, and to cash out any credits remaining on the gaming machine 100. In addition to initiating basic game functions, the buttons may also be provided to allow the player to reserve the machine or display additional information related to the game on the primary display 112 for a period of time. While the user interface is depicted as the button panel 170, some embodiments may use a touch sensitive panel instead of, or in conjunction to, buttons. In addition to the button panel 170, a touchscreen 113 overlaying the primary display 112 of the main cabinet 105 is provided to allow players to interact with the game in a direct manner. In other embodiments, a pull lever (not shown) may be positioned on one side of the gaming machine 100 to initiate spinning of the reels.

One or more payment devices may be provided on or near the console 180 to allow the player to transfer a monetary value to the gaming machine 100. FIGS. 1 and 2 depict a number of payment devices, including a note validator 111 and coin validator 110 to allow a player to insert cash into the gaming machine 100. In alternative forms, the note validator 111 and the coin validator 110 also function as a ticket validator and token validator, respectively, to allow the gaming machine 100 to accept non-cash forms of monetary value in use by the operator of the gaming machine 100, such as tickets or tokens. In other embodiments, a card reader 109 is included to allow players to make electronic transfers from a credit or bank account directly to the gaming machine 100.

In the embodiment shown in FIG. 1, the gaming machine 100 includes a coin tray 186 for the collection of coins or tokens dispensed by a coin hopper 188 (FIG. 2) after a player cashes out any remaining credits from the gaming machine 100. The gaming machine 100 may also include a ticket dispenser (not shown) that prints or otherwise generates a ticket, allowing players to redeem their remaining credits for cash at a cashier or cashpoint terminal. Alternatively, the players may choose to transfer their remaining credits to a different gaming machine by inserting the ticket into the ticket validator of another gaming machine.

The gaming machine 100 may include a number of mechanical meters 108 to record key aspects of usage (e.g., total credits in, total credits won, total credits contributed to jackpot wins, etc.) to comply with various gaming regulatory bodies.

The gaming machine 100 may also include a set of speakers (not shown) located near the front of the main cabinet 105 to provide audio content in the form of sound effects and music when a particular event occurs within the game. The speakers may also be used to provide an audible alarm in relation to a particular state or condition of the gaming machine 100, as previously mentioned.

FIG. 2 shows a system block diagram of the gaming machine 100 of FIG. 1. As shown in FIG. 2, the gaming machine 100 includes at least one central processing unit (CPU) 202. Herein, the term CPU 202 is used in a generic sense to refer to any computational device that may be used to control the operation of the gaming machine 100, such as a processor, microprocessor, microcontroller, programmable logic device (PLD), personal computer (PC), or application specific integrated circuit (ASIC).

The CPU 202 is in communication with at least one storage device 204, which may contain an operating system (O/S) program, system driver programs, random number generator (RNG) programs, and game programs of the gaming machine 100. Since the game program is conventionally stored separately from the O/S, system drivers, and RNG program, herein collectively referred to as the "platform," the storage device 204 may include media storage devices (e.g., compact flash cards) dedicated to storing either the game program or the platform.

The CPU 202 is in communication with a memory 206 used to store computing instructions of the platform and the game program as well as other data after being loaded from the storage device 204 for execution by the CPU 202. The memory 206 may include a variety of volatile and non-volatile memory devices. By way of example, and not limitation, the memory 206 may include Synchronous Random Access Memory (SRAM), Dynamic RAM (DRAM), Read-Only Memory (ROM), Flash memory, and the like.

The CPU 202 may also be referred to herein as processing circuitry. As a non-limiting example, when implemented as custom circuitry, the processing circuitry can be configured for carrying out embodiments of the present disclosure. As another non-limiting example, the processing circuitry may include memory 206 for holding computing instructions and one or more processors for executing the computing instructions.

The CPU 202 may also be in communication with non-volatile memory 214 (e.g., Non-Volatile RAM (NVRAM)), which may be used to store information that is retained after power is turned off. For example, the NVRAM 214 may be used to store data relating to game processes to ensure the game can be restarted in the event of a power failure at the exact point during the game when the power failure occurred. The NVRAM 214 may also keep historical information required by gaming authorities for auditing purposes, such as metering information (e.g., total credits input, total credits won, etc.) to ensure the gaming machine 100, and gaming establishment operating it, comply with gaming regulations.

One or more Input/Output (I/O) interfaces 208 may be included in communication with the CPU 202 to interface to I/O devices, such as, for example, card reader 109, coin validator 110, note validator 111, touchscreen 113, button panel 170, coin hopper 188, keyboards, mice, joysticks, haptic devices, microphones, speakers and cameras.

One or more communication elements 210 (noted as "network" in FIG. 2) may be included in communication with the CPU 202 for communicating with other devices or communication networks. As non-limiting examples, the communication elements 210 may include elements for communicating on wired and wireless communication media, such as for example, serial ports, parallel ports, Ethernet connections, universal serial bus (USB) connections, IEEE 1394 ("firewire") connections, THUNDERBOLT™ connections, BLUETOOTH® wireless networks, ZIGBEE® wireless networks, 802.11 type wireless networks, cellular telephone/data networks, and other suitable communication interfaces and protocols.

One or more graphics controllers 212 may be included in communication with the CPU 202 for controlling graphical images presented on the primary display 112, the secondary display 122, and other displays that may be included in the gaming machine 100.

The gaming machine 100 may be configured to produce a reel display that comprises a different reel design or reel activity depending upon which particular play option is invoked by the selection of a player. Each reel may include a plurality of symbols associated with it, the symbols being elements of an array that comprises all of the symbols associated with all of the reels. In this manner, each reel represents a subdivision of the array, so that the array is notionally divided into discrete sub-arrays, each sub-array comprising the symbols associated with a corresponding reel. The relative position of the symbols on the reel during a play of a game is notionally or logically fixed, so the player sees a portion of each reel formatted in the form of a matrix. The matrix appears in a window displaying a number of rows in which a sequence of symbols virtually scrolls along the column in which the reel is displayed during a play. The symbols of the reel can thus be defined in terms of the particular reel and the corresponding sub-array of specific symbols associated with it and the placement of a symbol in the sequence of symbols comprising the sub-array.

In some embodiments, there may be different sized windows for one or more reels. In such a case, a rectangular matrix or array may not be formed but the game will still work in substantially the same way.

Figure 3:
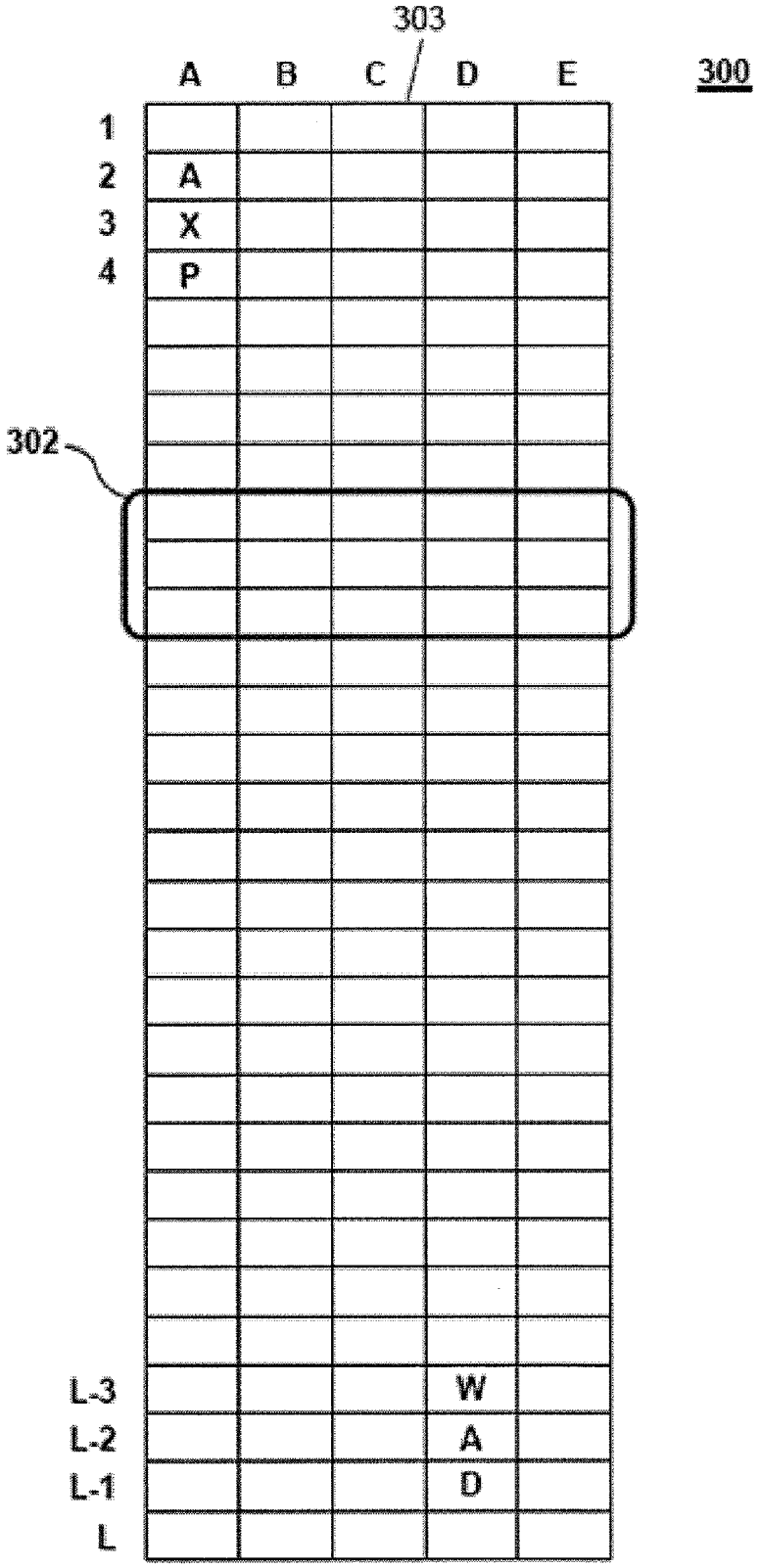
FIG. 3 illustrates an example of a multiple reel array, which may be used in some embodiments of the present disclosure.

FIG. 3 illustrates an example of an electronic reel simulation of a multiple reel array, which may be used in some embodiments of the present disclosure. As shown in FIG. 3, a matrix of symbols may be configured as a five-reel array 300, which has reels A, B, C, D, and E, each reel having L symbols. The symbols are displayed in a repeating sequence, so that 1 follows L (or, alternatively, L follows 1) in a loop until the reel stops. The symbols logically fill fixed positions in the array 300 in a prescribed manner.

A window 302 spanning three rows and the five columns is shown to indicate a pay window on the screen. This pay window may also be referred to herein as an array 302 of displayed positions.

Thus, a symbol can be represented by the column identifier (A, B, etc.) and the row number. Referring also to FIGS. 1 and 2, an image of a symbol is displayed by action of the CPU 202 and signals sent to the display 112, and the images and/or combinations of images at different displayed positions may be allocated different values and provide different winning opportunities depending upon their occurrence in prescribed combinations as determined by a paytable defined for the wagering game played on the gaming machine 100. In yet other embodiments, the reel set may be changed from game to game to alter the probability of a symbol appearing, alter the probability of a stack of a symbol appearing, or a combination thereof.

The probability of a particular symbol being displayed on a reel or a virtual reel may be determined by the number of that type of symbol in a reel divided by the total number of symbols in the reel (L), in the absence of mathematical weighting of the symbols. In some embodiments, no mathematical weighting is applied to the individual symbols other than their natural frequency of occurrence from within the total number of available symbols. Thus, where there is only one of a particular symbol in a reel, its probability of appearing in a specific position, such as the centerline of the window, is 1/L. In other embodiments, certain symbols may be weighted such that the probability of appearance is altered.

In playing a game, the program may use a pseudo-random number generator to determine which symbols will be displayed in the window 302 for each reel by selecting a number between 1 and L for each reel to appear, for example, on centerline 303. Thus, a particular symbol and its neighboring symbols (each symbol typically being independently selected randomly or pseudo-randomly) will appear in the window 302 where three horizontal lines are displayed. It will be understood that in different embodiments, and indeed in different play options associated with the same game of each embodiment, the reels A, B, C, D and E may be of the same or different lengths and that the lengths of each reel may be independent of one another. That is, there is no requirement that the reel lengths be equal, multiples of each other, or have any other dependency on one another, between the different play options. Accordingly, the probability of a particular symbol appearing in a specific position in the window 302 is dependent on the number of that particular symbol contained on that particular reel and the length of that reel.

As shown in FIG. 3 for illustration, three consecutive symbols A, X, and P are shown in reel A at positions 2, 3, and 4, and a further three consecutive symbols W, A, and D are shown in reel D at positions L-3, L-2, and L-1. FIG. 3 illustrates the position of the reels at the beginning of a selected play option for a particular game. For the sake of explanation, row 1 is shown at the top of the matrix. In practice, the symbol corresponding to row 1 will be in a position determined by the result of the previous game.

Figure 8:
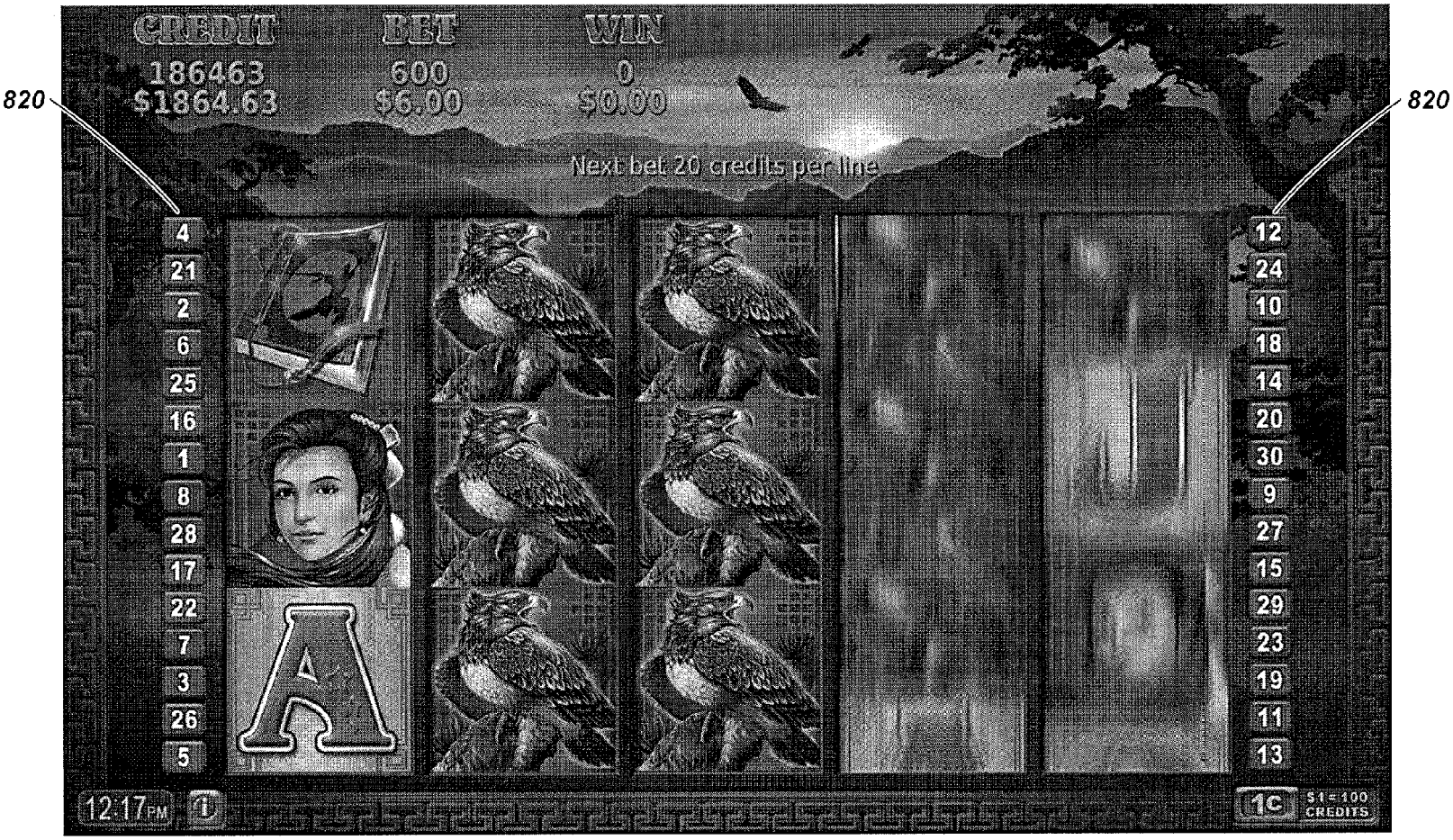
FIGS. 8-11 show a sequence of game displays illustrating reel spins resulting in a block pay.
Figure 9:
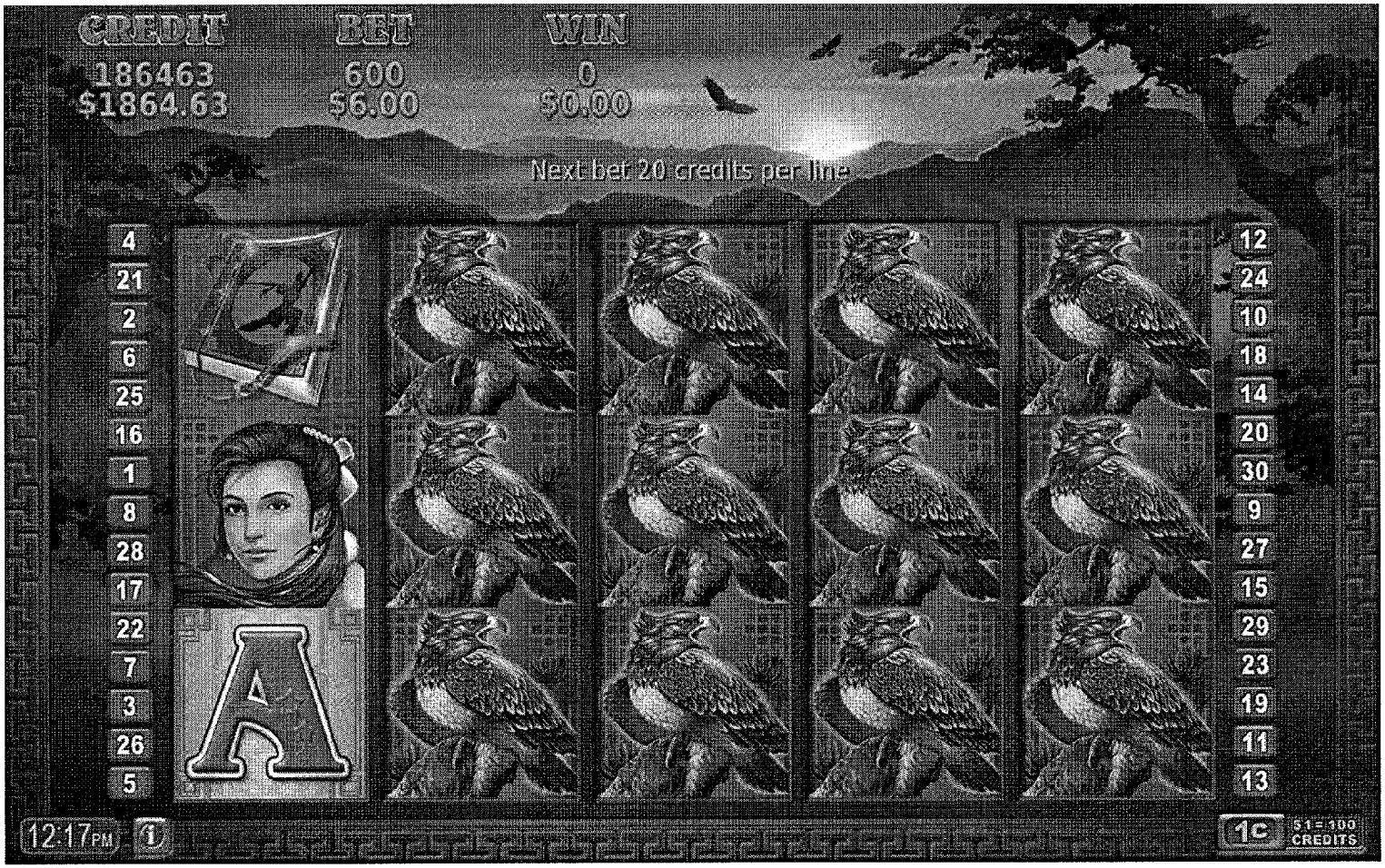

Many drawings, such as, for example, FIGS. 8 and 9 show a main game screen for embodiments of the present disclosure. As shown in FIG. 9, the main game screen displays a number of simulated reels. Each reel strip may be configured as a predetermined length and arrangement, such that each symbol from the set may be used more than once in the reel strip. Each reel strip is displayed on the reel in a repeating sequence, such that the ends of the reel strip are joined to form a loop, until the reel stops spinning. In the embodiment shown, each reel is arranged relative to each other to form a series of columns. Each column displays a number of symbol positions from each reel strip to define a playing window.

While the playing window is shown in most of the embodiments described herein as a rectilinear array having 5 columns and 3 rows, other sizes and configurations may be used in embodiment of the present disclosure. For example, at least one column of the playing window may display a different number of symbol positions than other columns in the array. In other configurations the display may stagger the symbol positions of adjacent columns such that the symbol positions do not align to form straight rows, but instead form meandering paths across the playing window. Furthermore, one or more columns may include more than one reel. For example, in a column having three symbol positions, each symbol position may display a symbol from a different reel strip, such that the column is formed from three separate reels.

FIGS. 4A-4F show various arrangements of stacks and block arrangements in an array of displayed positions.

As used herein, the term "stack" means two or more adjacent positions on displayed positions of the array. The adjacent positions may be in a vertical direction or a horizontal direction. As non-limiting examples, a stack may be in a vertical direction and include two, three, four, or more adjacent positions. As other non-limiting examples, a stack may be in a horizontal direction and include two, three, four, or more positions.

As used herein the term "block arrangement" means a combination of two or more stacks on displayed positions of the array. Each of the stacks is the same size and include symbols aligned in a first direction. Within the block arrangement, each stack occupies a different position within the array in a second direction perpendicular to the first direction and the stacks are aligned in the second direction.

FIG. 4A illustrates a vertical stack 410 of three adjacent displayed positions. FIG. 4B illustrates a horizontal stack 420 of five adjacent displayed positions.

FIG. 4C illustrates a three-by-four block arrangement 430 as an example block arrangement. This non-limiting example may be considered as the first direction running vertically and the second direction running horizontally. Thus, there are four vertical stacks 432 that are horizontally adjacent and each of the four vertical stacks includes three vertically adjacent display positions. In addition, the tops of the four vertical stacks 432 are aligned along horizontal position 434.

FIG. 4D illustrates an alternative definition of the three-by-four block arrangement 430 of FIG. 4C. The three-by-four block arrangement 430 also may be considered with the first direction as horizontal and the second direction as vertical. In this interpretation, there are three horizontal stacks 436 that are vertically adjacent and each of the three horizontal stacks includes four horizontally adjacent display positions. In addition, the sides of the four vertical stacks are aligned along vertical position 438. In the three-by-four block arrangement 430 shown in FIGS. 4C and 4D, the stacks are adjacent. In some embodiments, however, a block arrangement may be defined such that stacks need not be adjacent.

FIG. 4E illustrates a three-by-three block arrangement 440 as an example block arrangement with non-adjacent stacks. In this non-limiting example, there are three vertical stacks 442 and each vertical stack includes three vertically adjacent display positions. Each of the three vertical stacks 442 is aligned along horizontal position 444. In this example the stacks are not horizontally adjacent. However, since there are three stacks and they are the same size and similarly aligned, they are considered as making up the three-by-three block arrangement 440. Of course, in definitions of block arrangements with non-adjacent stacks, some of the stacks may be adjacent while other stacks are non-adjacent.

FIG. 4F illustrates a three-by-two block arrangement 450 as an example block arrangement with non-adjacent stacks. In this non-limiting example, there are two horizontal stacks 456 and each horizontal stack includes three horizontally adjacent display positions. Each of the two horizontal stacks 456 is aligned along vertical position 458. In this example the stacks are not vertically adjacent. However, since there are two stacks and they are the same size and similarly aligned, they are considered as making up the three-by-two block arrangement 450.

For ease of description, most of the embodiments described herein concentrate on vertical stacks of three positions in a display array of three vertical and five horizontal display positions. However, unless specifically recited as such in the claims, other embodiments are not limited by these specifically described embodiments and may include other reel configurations, other sizes of display arrays, other orientations of the stacks and other sizes of the stacks. For example, display arrays consisting of triangular, diamond, hexagonal, circular, or other shaped display positions may not include horizontal rows or vertical columns to define when a block arrangement is formed. Therefore, a block arrangement may be defined as formed when a predetermined number of matching symbols or same type of symbols (as discussed in more detail later) form a particular shape, pattern or area within the display array.

FIG. 5 shows a game display illustrating a paytable for an embodiment of the present disclosure. The paytable as defined in this non-limiting embodiment provides wins for symbols appearing in symbol positions that form combinations according to a prescribed set of rules provided in the paytable. Symbols can generally be classified into one of two different types, namely base symbols and special symbols.

In FIG. 5, base symbols include card symbols 512, an eagle symbol 522, a book symbol 524, a lady symbol 526, and a hero symbol 528. Special symbols include a temple symbol 550 and a sword symbol 560.

Base symbols provide wins for symbol combinations formed along active paylines or paths (as discussed in more detail later), which may start from the left-most column of the playing window. Alternatively, wins may be provided for symbol combinations starting from the right-most column of the playing window instead of, or in addition to, symbol combinations running left-to-right.

Base symbols can further be categorized into one of two types, namely minor symbols and major symbols. In FIG. 5, the card symbols 512 are minor symbols. Minor symbols provide wins of relatively low value when they form a winning symbol combination. As a non-limiting example, symbols or indicia commonly found on playing cards, such as "9," "10," "J," "Q," "K," and "A" may be used to depict minor symbols.

Major symbols provide wins of higher value when compared to minor symbols. Major symbols typically use pictures of characters, animals, or objects relating to a particular subject to provide the game with a common theme, as well as allowing major symbols to be more easily distinguished from minor symbols since the appearance of these symbols in the playing window is more desirable. In FIG. 5, the eagle symbol 522, the book symbol 524, the lady symbol 526, and the hero symbol 528 are major symbols.

Special symbols are symbols that provide additional wins or bonuses in the game. In FIG. 5, the temple symbol 550 and the sword symbol 560 are special symbols. One symbol type which is considered special is a wild symbol (the temple symbol 550) since it can substitute for other symbols within the playing window to form a winning symbol combination. In addition, a multiplication factor may be assigned to the wild symbol that multiplies the wins awarded for any winning symbol combinations which include the wild symbol in the formation of the combination.

Scatter symbols (the sword symbol 560) may also be considered as a type of special symbol since they may not be required to occur on an active payline or path to form a winning symbol combination. Rather, wins may be provided based on the number of scatter symbols that appear within the playing window, regardless of the order or position in which they appear. Scatter symbols may also be used to trigger a bonus feature, such as a free spin round or bonus game when a particular number of scatter symbols appear in the playing window.

Other symbols which are special include background symbols. As the name implies, background symbols are applied to the background of other symbols and may provide a special bonus in the form of a win multiplier, jackpot, or feature game that is triggered if the symbol to which the background symbol is applied is included in a winning symbol combination. A stack frame discussed below is a type of background symbol.

As non-limiting examples, the paytable of FIG. 5 illustrates payouts for winning combinations that include the various symbols. For the card symbols 512, a combination of 3 symbols pays 3 times the bet, a combination of 4 symbols pays 8 times the bet, and a combination of 5 symbols pays 12 times the bet.

For the eagle symbol 522 and the book symbol 524, a combination of 3 symbols pays 4 times the bet, a combination of 4 symbols pays 10 times the bet, and a combination of 5 symbols pays 20 times the bet.

For the lady symbol 526, a combination of 2 symbols pays 2 times the bet, a combination of 3 symbols pays 6 times the bet, a combination of 4 symbols pays 12 times the bet, and a combination of 5 symbols pays 30 times the bet.

For the hero symbol 528, a combination of 2 symbols pays 2 times the bet, a combination of 3 symbols pays 8 times the bet, a combination of 4 symbols pays 15 times the bet, and a combination of 5 symbols pays 40 times the bet.

For the sword symbol 560, a combination of 2 symbols pays 3 times the bet and a combination of 3 symbols pays 10 times the bet.

Finally, for the temple symbol 550, the paytable indicates that the temple symbol 550 can only appear on reels 2, 3, and 4 and functions as a wild symbol for all other symbols except the sword symbol 560, which also only appears on reels 2, 3 and 4.

Figure 6:
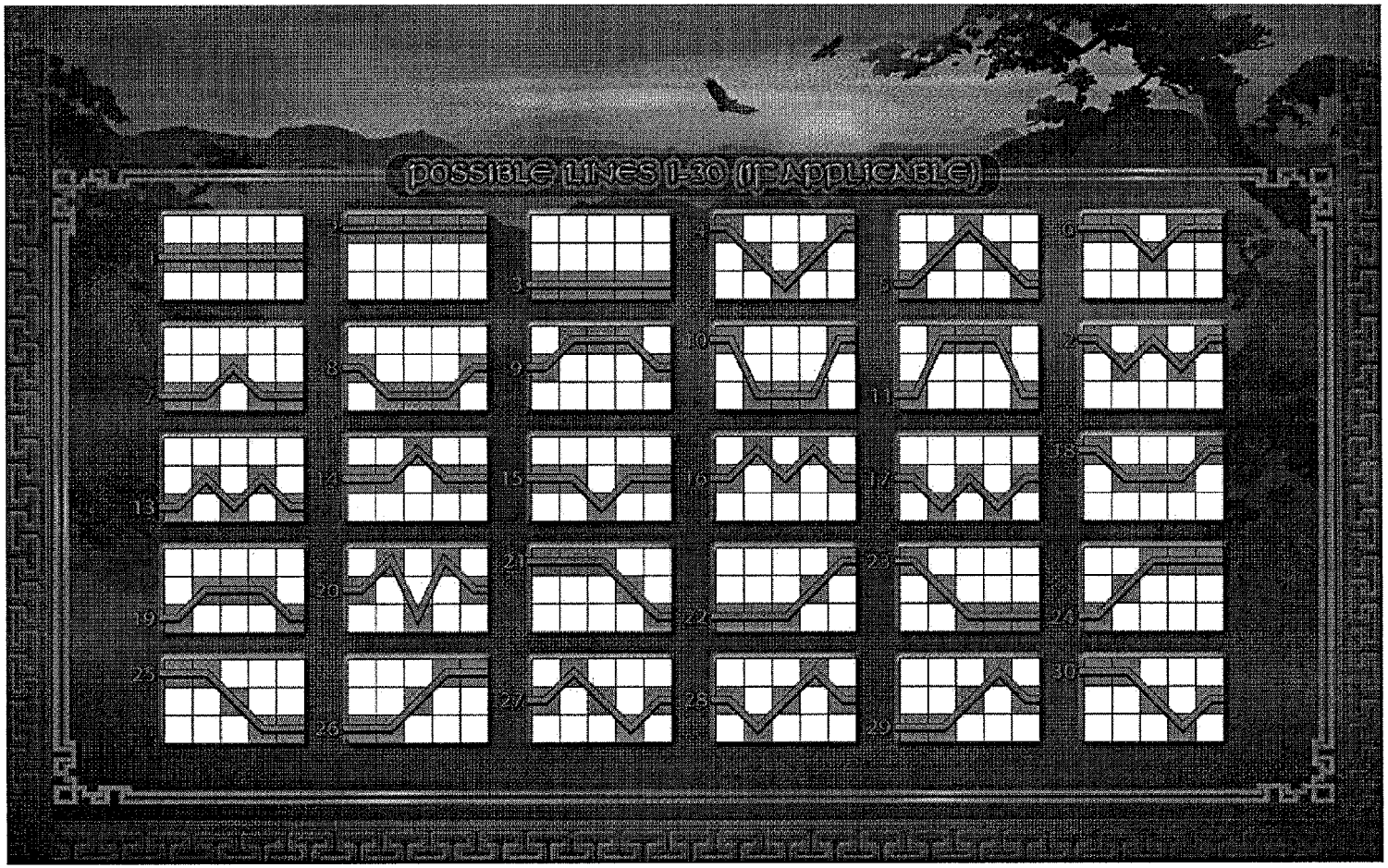
FIG. 6 shows a game display illustrating possible paylines for an embodiment of the present disclosure.

FIG. 6 shows a game display illustrating possible paylines for an embodiment of the present disclosure. In some embodiments that include paylines, players initiate the spinning of reels by selecting the number of active paylines they wish to play in each game, together with how much they wish to wager per active payline. In some embodiments, the player may only be allowed to select a particular number of active paylines to play in each game, such as one, three, five, ten, fifteen, or other suitable number up to the maximum number provided in the game.

The payline patterns are used to define the particular lines that will provide a line win if a symbol combination appears on the line. In some embodiments, line wins provide a payout for symbol combinations appearing left-to-right only across the reel array (i.e., a symbol combination must appear in the left-most column of the reel array and in adjacent order on the reels). However, other embodiments allow line wins to provide a payout for symbol combinations appearing right-to-left across the reel array as an alternative, or in addition to, paying left-to-right only. Line wins can also be provided for symbols appearing in adjacent order across a payline, regardless of starting position, or for symbol combinations that appear anywhere on a payline, regardless of order. Games that use paylines to define winning symbol combinations typically allow players to select the number of paylines they wish to buy for each spin, in which case line wins are only provided for "active" paylines that the player has bought (e.g., 1, 5, 10, 20, or 30 credits buys 1, 5, 10, 20 or 30 paylines, respectively). In some embodiments, the player can also adjust the total wager played by selecting the number of credits to wager per line. While it is theoretically possible for a reel-type game having a reel array of 5 columns and 3 rows to have a maximum of 243 different paylines active (i.e., no. of rows^no. of columns=3^5) in one direction, some embodiments may limit the number of paylines provided in each game to 50 lines or less, as an example. Since more than one active payline can pass through the same symbol positions of the playing window, multiple awards can be provided for the same winning symbol combination.

While the embodiments discussed herein generally depict a reel-type game using paylines to define winning symbol combinations (i.e., line games), the BLOCK PAYS® feature discussed below can also be applied to other reel-type games that allow the players to select a number of paths or "ways" they wish to play for each game by buying one or more reels or columns. In buying columns, all of the displayed symbol positions of the bought column are made "active," while all other columns have only one active symbol position available. In other words, any one of the symbols displayed in the bought column can form part of a winning symbol combination. Accordingly, in a reel-type game having a reel array of 5 columns by 3 rows, a player can select to play either 3, 9, 27, 81 or 243 ways in each game by buying 1, 2, 3, 4 or 5 columns, respectively. However, in contrast to paylines where more than one active payline can pass through the same symbol positions of the reel array to provide multiple line wins for the same winning symbol combination, selecting the number of active ways to play during each game will only provide one award for each winning symbol combination.

In embodiments where the number of paylines or ways to win is fixed, the player has less flexibility in choosing the amount of credits they wish to wager in each game. To overcome this scenario, a new betting system where players may increase their wager by purchasing one of a number of different play options may be included in some embodiments. This new betting system, marketed by the Applicant under the trade name ALL UP™, is described in U.S. Pat. No. 9,747,751, filed Mar. 8, 2011, issued Aug. 29, 2017, titled "Method and System for Gaming," which is incorporated herein by reference in its entirety.

With particular reference to the ALL UP' betting scheme, each play option is associated with at least one major symbol that is subsequently upgraded from a base value to an enhanced value if that particular play option is purchased. To comply with gaming regulations of some jurisdictions, each reel may use different reel strips to ensure the same average return-to-player is maintained throughout the game, regardless of the play option selected. In terms of game design, major symbols logically constitute additional symbols when they are subsequently upgraded and at the same time allow a common theme to be followed in terms of their selection between a base value and an enhanced value according to the particular play option selected. In this manner, the same theme can be maintained between different play options to provide the player with the feeling of playing the same game regardless of the play option selected, when in reality each play option provides a different gaming experience as measured by its volatility.

The number of symbol stacks appearing in a reel may also change according to the bet. This change could involve changing the number of that symbol on the reel or just changing the positions of the symbols on the reel. Changing symbol stack probability over one or more reels may result in a change in probability of specific Block Pays. In particular, the probability of a specific Block Pay or all Block Pays may increase linearly with the size of the players bet. For example, as players increase their bet, more stacks of a symbol may be provided on a reel by changing the position a symbol appears on the reel so that the chance a block pay will occur linearly increases with the bet.

Figure 7:
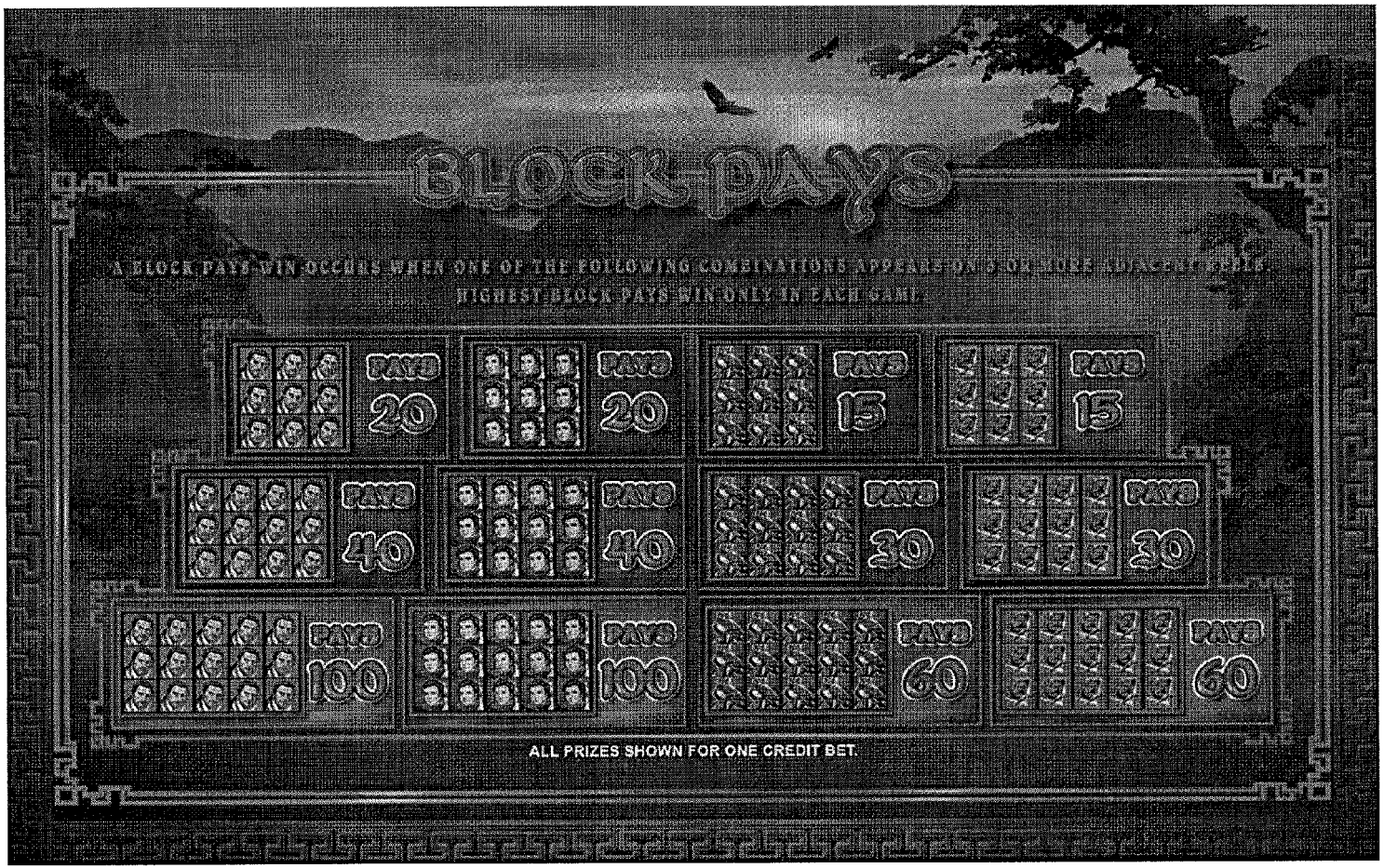
FIG. 7 shows a game display illustrating possible pays for a game outcome that includes winning blocks of matching symbols in a block configuration for an embodiment of the present disclosure.

FIG. 7 shows a game display illustrating possible pays for a game outcome that includes winning blocks of matching symbols in a block configuration for an embodiment of the present disclosure. The BLOCK PAYS® feature paytable sets out the award amounts provided for block pays wins. In one embodiment, only certain types of symbols, namely the major symbols, appear as stacks within the game. Therefore, it is only possible to award a block pay for these symbols. However, it is to be appreciated that a block pay win may be awarded for other types of symbol, namely minor symbols and special symbols, providing these symbols appear as stacks on the reels. As depicted in the BLOCK PAYS® feature paytable, the payout provided for a block pay will depend on the size of the block and the type of symbol that forms the block. However, in alternate forms, the payout may be based on the location that the block arrangement appears within the display array instead of, or in addition to, the size of the block arrangement and the type of symbol that forms it.

In the embodiment of FIG. 7, the block pay table indicates that the displayed symbols must be on adjacent reels (e.g., adjacent stacks). However, as discussed earlier with reference to FIGS. 4A-4F block arrangements may be defined in other embodiments with non-adjacent stacks. In FIG. 7, and also referring to FIG. 5 for the definition of the symbols, block pays are only awarded for the major symbols, namely the eagle symbol 522, the book symbol 524, the lady symbol 526, and the hero symbol 528, which that form blocks of matching symbols. However, it should be appreciated that in other embodiments, a block pay win may also be awarded for a block of different symbols belonging to the same type. For example, a block pay may be awarded for a mixed block of minor symbols. In other implementations, a block pay may be awarded by a particular combination of symbols appearing within a block.

For the eagle symbol 522 and the book symbol 524, three-by-three blocks of matching symbols pay 15 times the bet, three-by-four blocks of matching symbols pay 30 times the bet, and three-by-five blocks of matching symbols pay 60 times the bet.

For the lady symbol 526 and the hero symbol 528, three-by-three blocks of matching symbols pay 20 times the bet, three-by-four blocks of matching symbols pay 40 times the bet, and three-by-five blocks of matching symbols pay 100 times the bet.

FIGS. 8-11 show a sequence of game displays illustrating reel spins resulting in a block pay. When describing the figures from this point on, reference may also be made to FIG. 5 for the definitions of the types of symbols, rather than showing symbol indicators on each of the figures with the reel spin displays.

FIG. 8 depicts a standard game currently in play where reels 1, 2 and 3 have stopped spinning, while reels 4 and 5 remain spinning (illustrated as a blurred effect on reels 4 and 5). Numbered squares 820 at either end of the reel array are used to indicate the number of active paylines the player has selected to play. In this case, 30 paylines are selected wherein each line costs 1 credit to play. The BET meter near the upper left corner shows a bet size of $6.00, in which case it can be deduced that the player has selected to play 20 credits per line (i.e., 30 lines×20 credits per line=600 credits, where 1 credit=1 cent). The WIN meter near the upper left corner indicates the number of credits won during each spin of each game played. At the end of each spin of the standard game, the WIN meter is added to the CREDIT meter and reset to zero for the next spin of the standard game. As can be seen, reels 2 and 3 have stopped with a vertical stack of three eagle symbols 522 to provide a chance of triggering a block pays win.

FIG. 9 shows reels 4 and 5 have now stopped and each of reels 4 and 5 include a vertical stack of three eagle symbols 522. Since reel 1 does not include any eagle symbols 522, the player does not receive any line wins, so the "win" meter stays at zero (in this particular embodiment, line wins pay left-to-right only). However, since reels 2, 3, 4, and 5 have all stopped on a vertical stack of eagle symbols 522, a four-by-three block pay win for that symbol is provided to the player.

Figure 10:
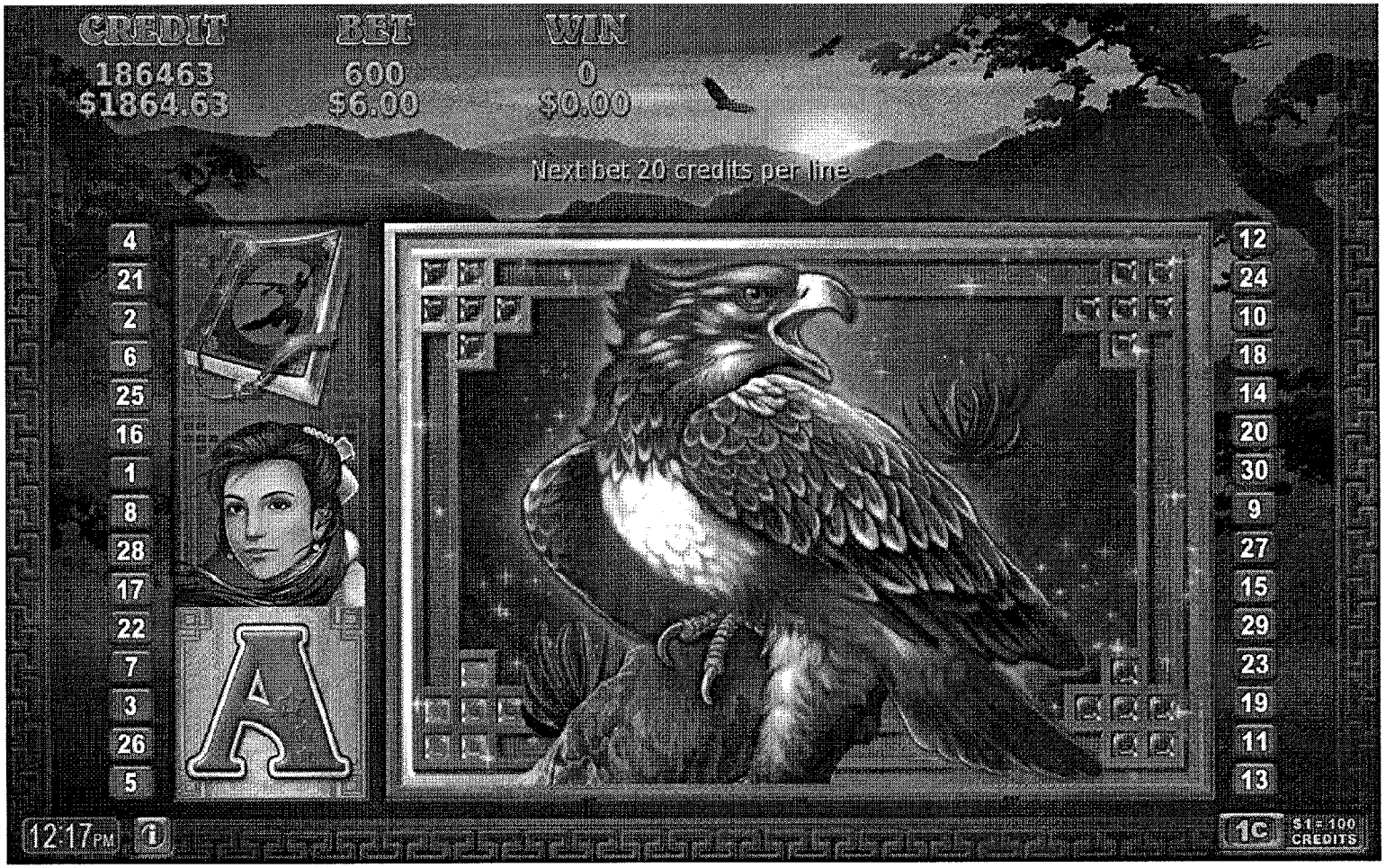
Figure 11:
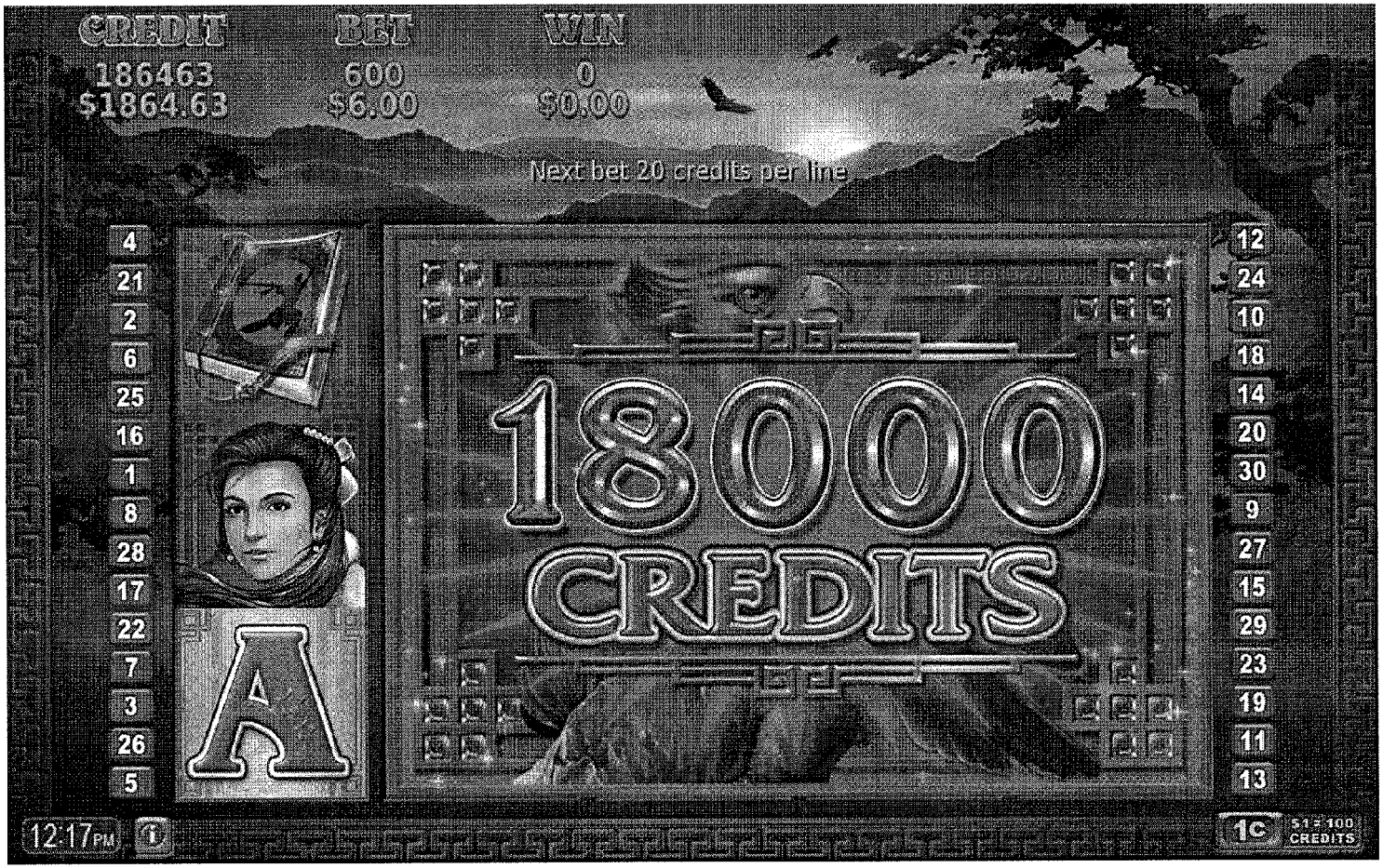

FIGS. 10 and 11 illustrate the block pay win. In this embodiment, the eagle symbol 522 is animated to expand over the four-by-three block as shown in FIG. 10. In FIG. 11 the block pay win amount is superimposed over the expanded eagle symbol. As shown in the feature paytable of FIG. 7, a four-by-three block of eagle symbol 522 pays 30 credits for each credit bet, such that the total block pay win amount is 18,000 credits (i.e., the player has wagered 600 credits in total). While not shown, the WIN meter will be increased to $180.00, and then reset to zero after these credits are added to the CREDIT meter.

In some embodiments, free game rounds may be included as part of the game play options. The free game plays may be won by various symbol combinations according to the rules of the game. In free games, any credits won during each spin may remain on the WIN meter and subsequently added to the CREDIT meter at the completion of the round of free games.

In the embodiment described in combination with FIGS. 7-11, credit prizes are awarded for block pay wins. In other embodiments, non-monetary awards could be awarded instead of, or in addition to, a credit prize. For example, a block pay win could be used to trigger a free game round, wherein the size of the block pay determines the number of spins provided in the free game round (e.g., a three-by-three, four-by-three, or five-by-three block pay win triggers a free game round of 9, 12, or 15 free spins, respectively). Other examples of non-monetary awards may include: applying a multiplier to all wins whenever a block arrangement is formed; transforming all symbols in a block arrangement to substitute symbols; and providing a respin whenever a block arrangement is formed for reels that are not part of the block arrangement.

Figure 12:
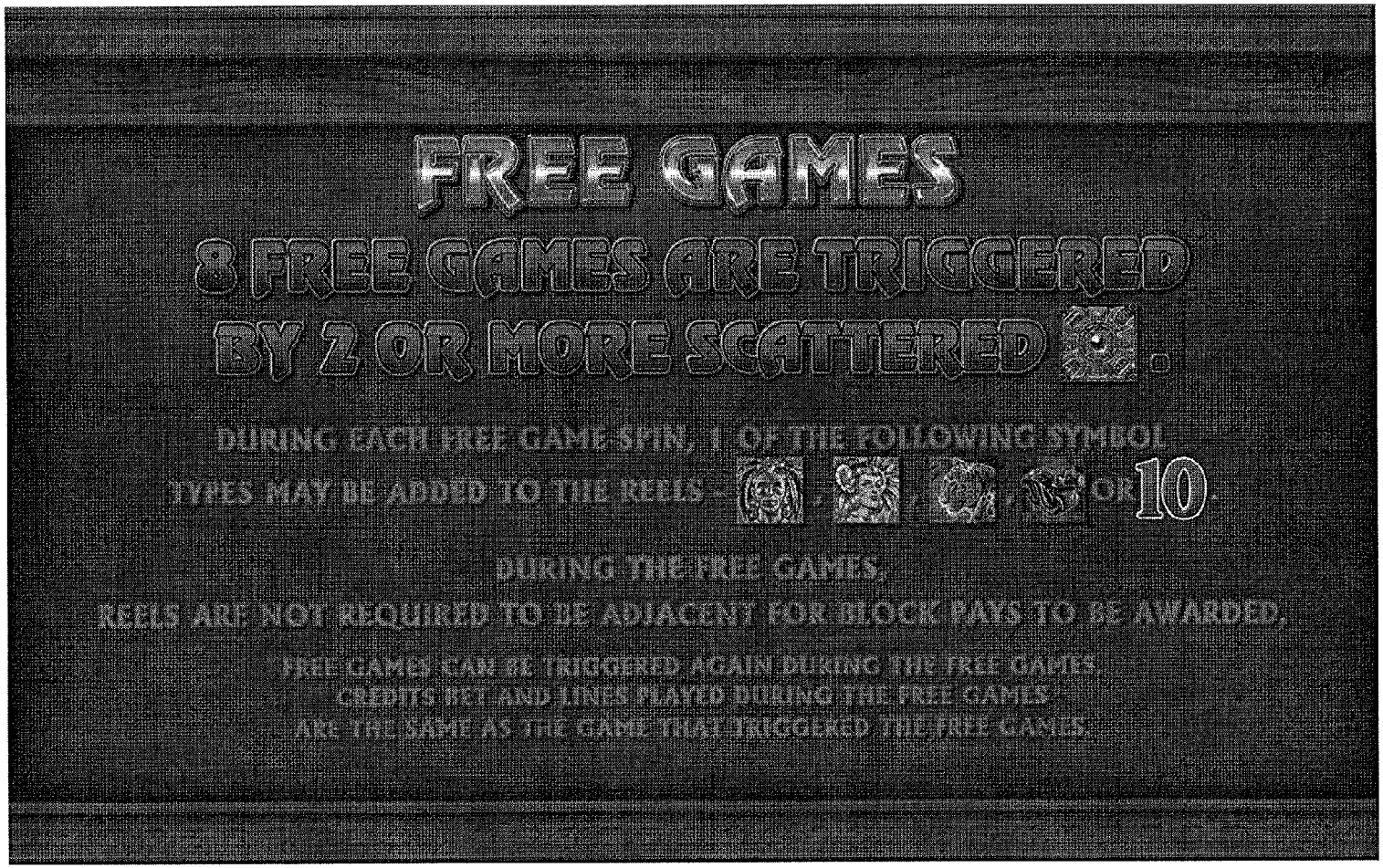
FIG. 12 shows a game display illustrating rules associated with an embodiment of the present disclosure that allows non-adjacent stacks to be considered for block pays.

FIG. 12 shows a game display illustrating rules associated with a further embodiment of the present disclosure that allows non-adjacent stacks to be considered for block pays. The presence of non-adjacent stacks may also be referred to in some embodiments as a sliding stacks feature as is explained below. FIG. 12 indicates the rules associated with a free games round of a standard game that uses Mesoamerican-themed symbols including a chief symbol, a princess symbol, a jaguar symbol, and a jade symbol. In this particular case, a round of eight free games is triggered when two or more scatter symbols (as depicted by an amulet symbol) appear in the reel array of the standard game, In one form, the rules indicate that reels (e.g., vertical stacks) need not be adjacent for a block pay win to be awarded during the round of free games. However, it should be appreciated that a block pay win may also be awarded for non-adjacent stacks occurring in a standard game.

Figure 13:
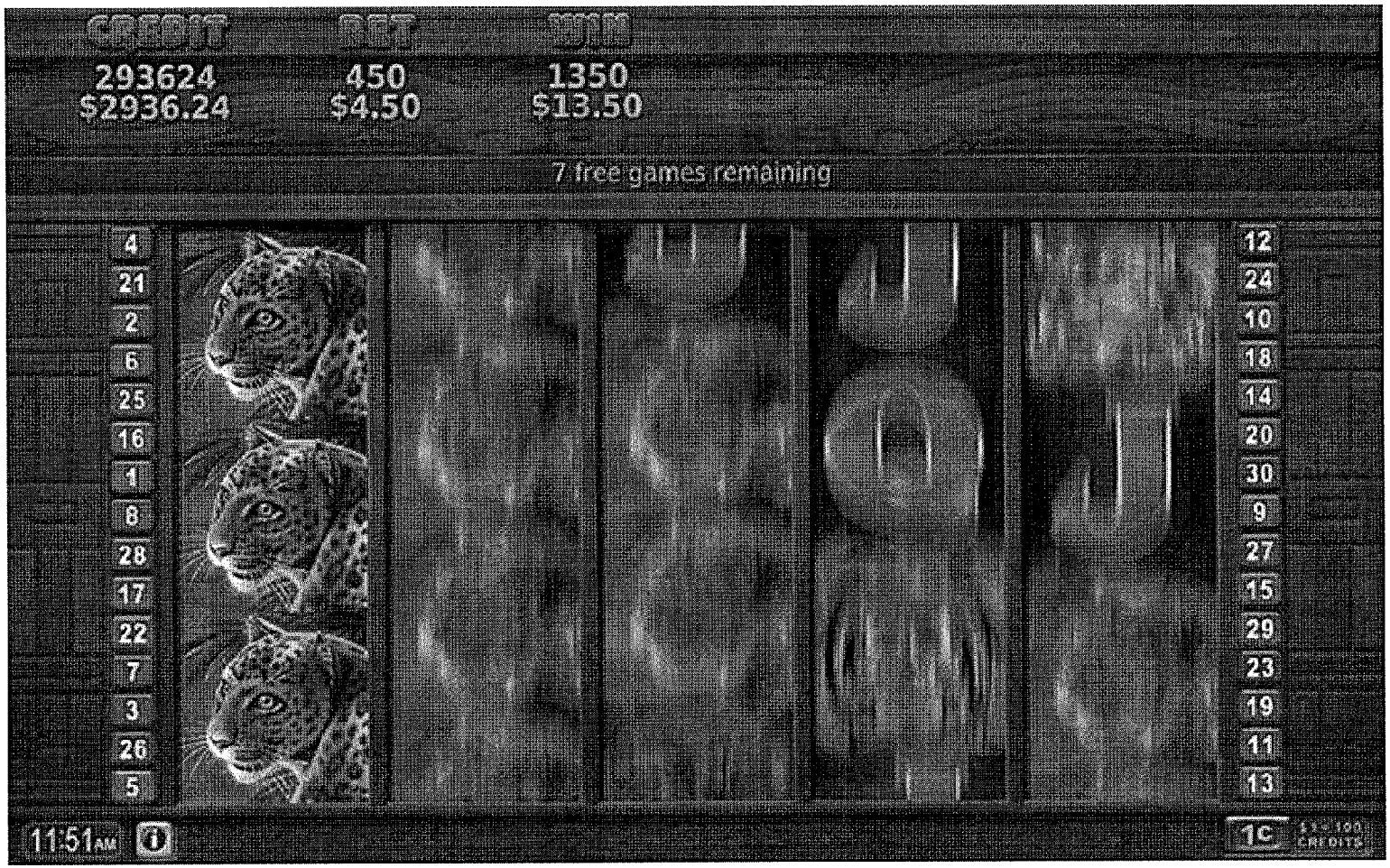
FIGS. 13-18 show a sequence of game displays illustrating reel spins resulting in a block pay that includes non-adjacent stacks.

FIGS. 13-18 show a sequence of game displays illustrating reel spins resulting in a block pay that includes non-adjacent stacks. FIG. 13 illustrates a free game round currently in play where reel 1 has stopped spinning, while reels 2, 3, 4 and 5 remain spinning. In this case, since this particular sequence was taken at the start of the free game round, it can be seen that the free spins counter above the reels indicates that 7 free spins are remaining in the free game round. Reel 1 is shown as stopped with a vertical stack of three adjacent jaguars. Reels 2-5 are shown as blurred to indicate that they are still spinning.

Figure 14:
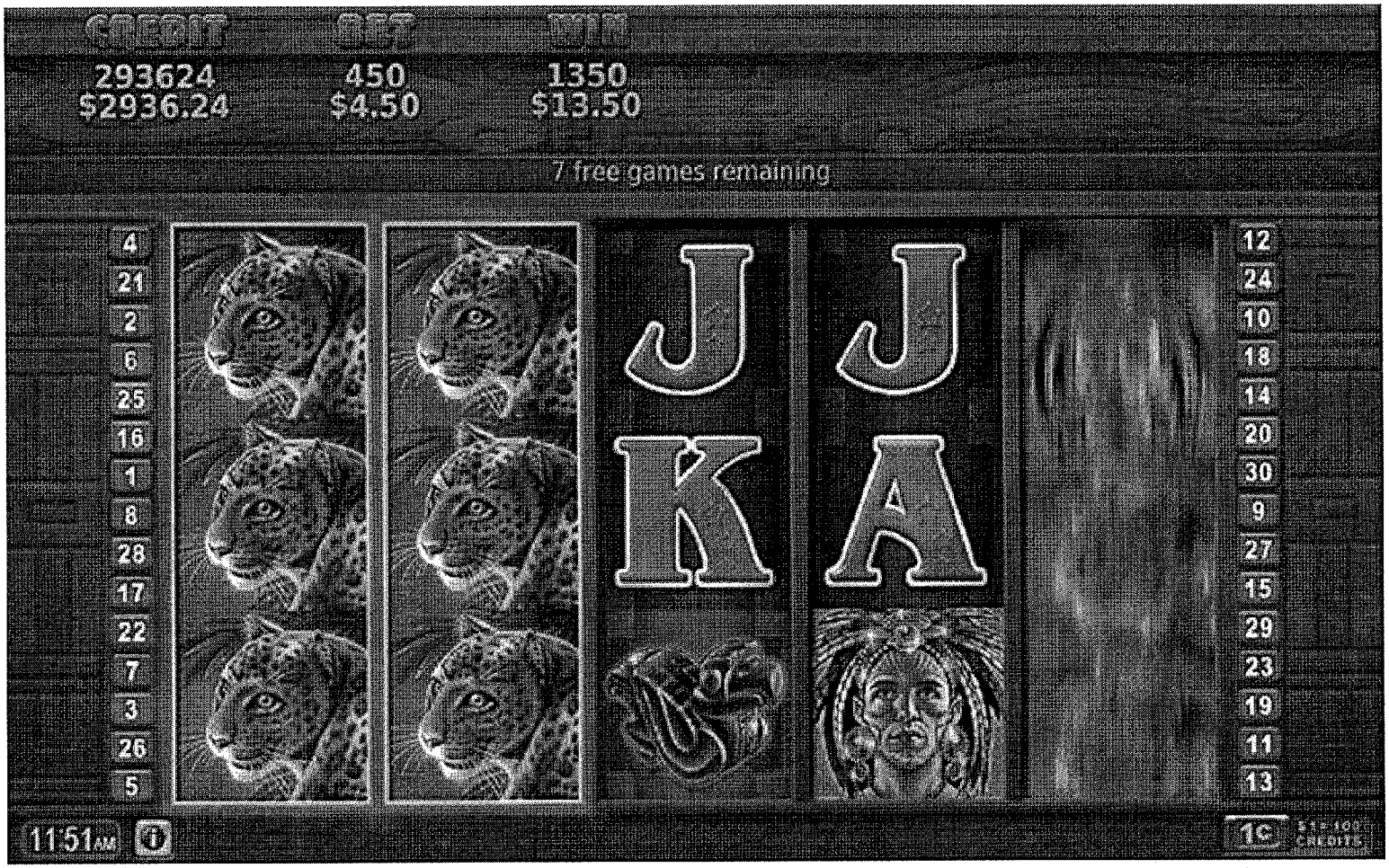

FIG. 14 shows reels 1, 2, 3, and 4 have now stopped, while reel 5 remains spinning. Reels 1 and 2 have stopped on a stack of symbols of the same type, namely, the jaguar symbol, while the symbol positions displayed on reels 3 and 4 do not include any jaguar symbols. Since the jaguar symbol only awards line wins for combinations of three or more symbols occurring on an active payline, the player is ineligible to win any line wins for this spin according to the paytable of this game. However, the player nonetheless remains eligible to win one or more block pays since symbol stacks are not required to appear in adjacent order.

Figure 15:
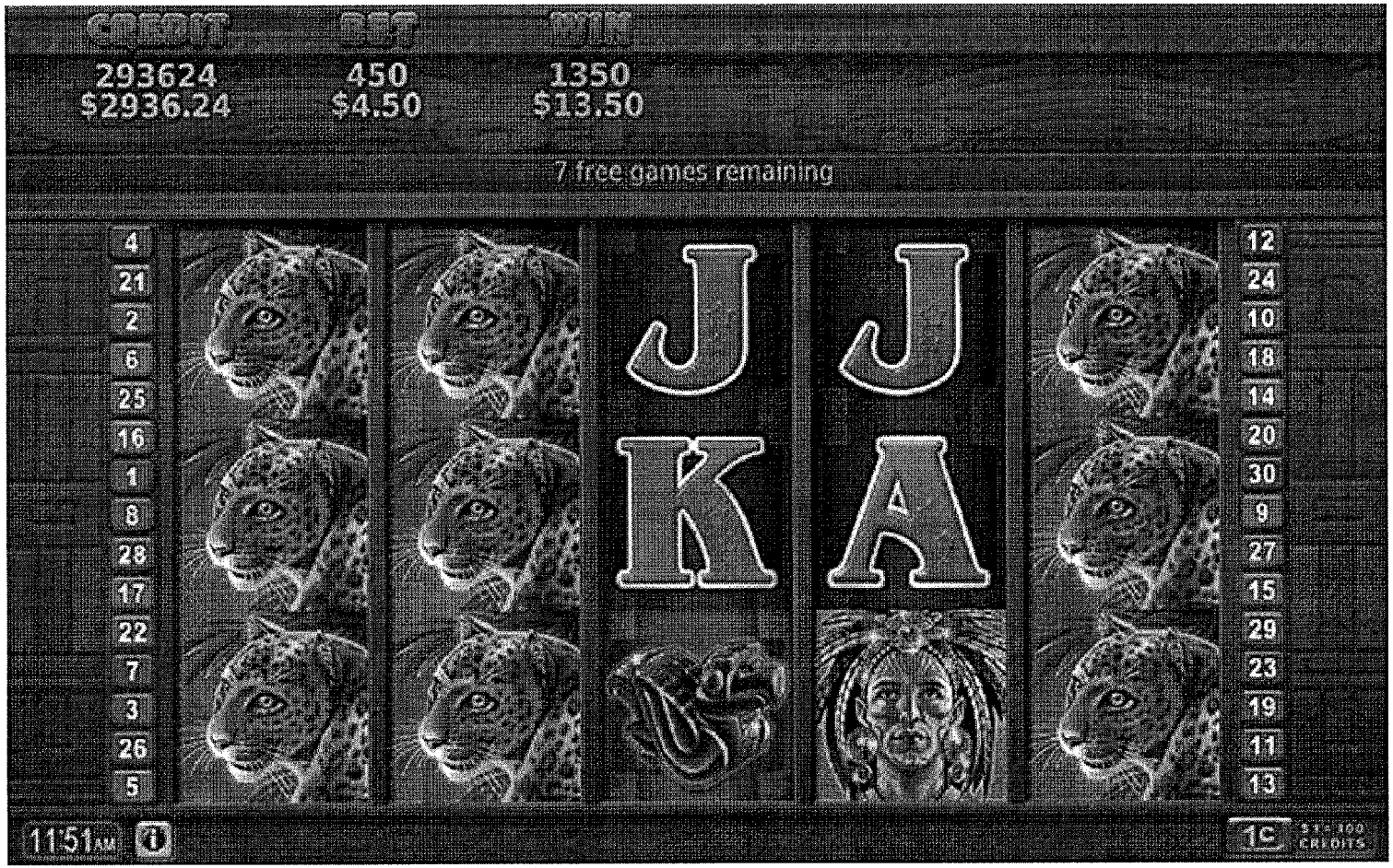

FIG. 15 shows all the reels have now stopped spinning. Given that reel 5 has also stopped and includes a vertical stack of three adjacent jaguars, reels 1, 2, and 5 can be combined to define a three-by-three block of matching jaguar symbols.

Figure 16:
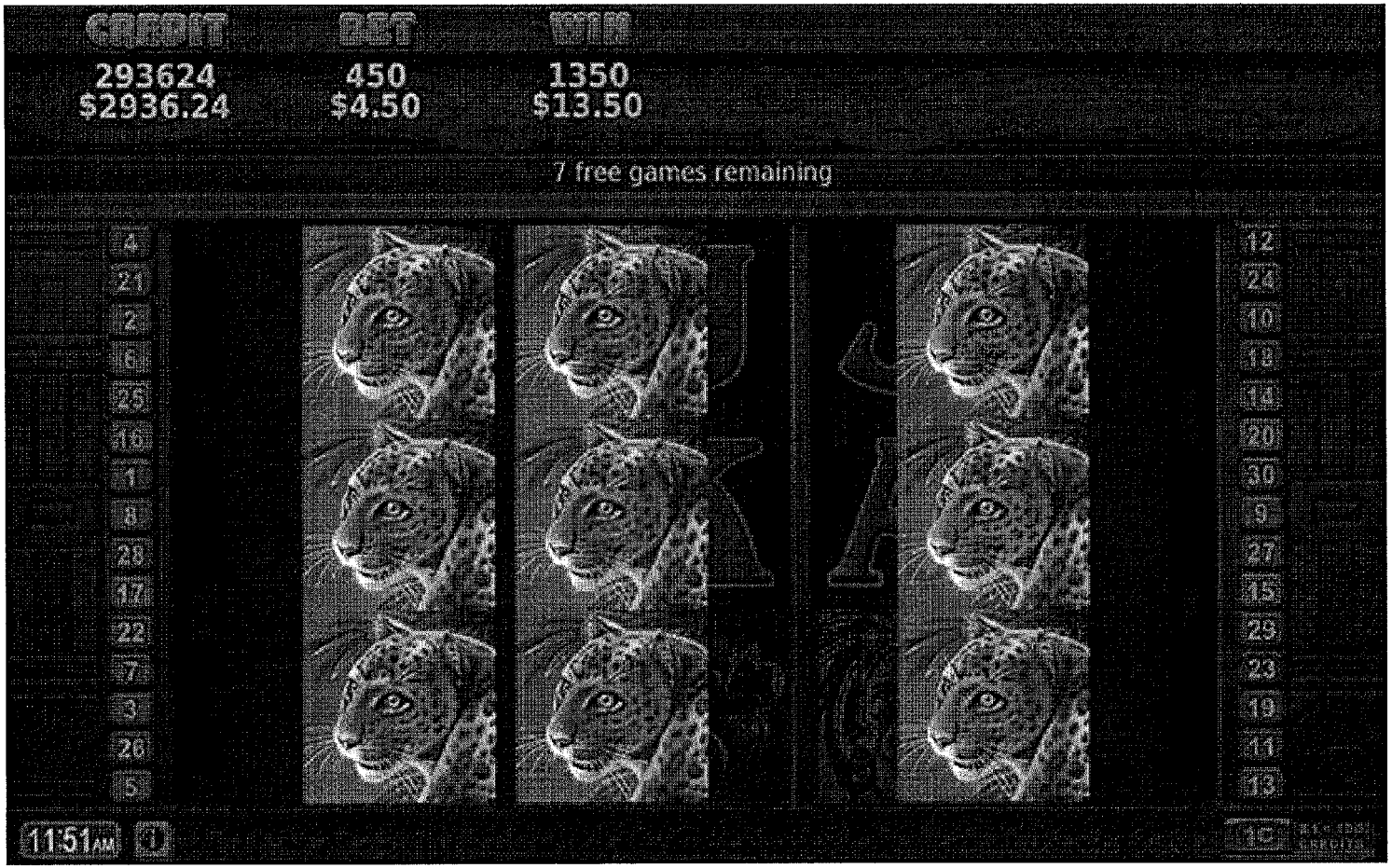

FIG. 16 depicts a frame of an animation sequence of the three vertical stacks sliding together to form a contiguous three-by-three block of jaguar symbols, which in this case pays 12 credits for every credit wagered, for a total of 5400 credits (i.e., 12 credits×450 credits=5400 credits).

Figure 17:
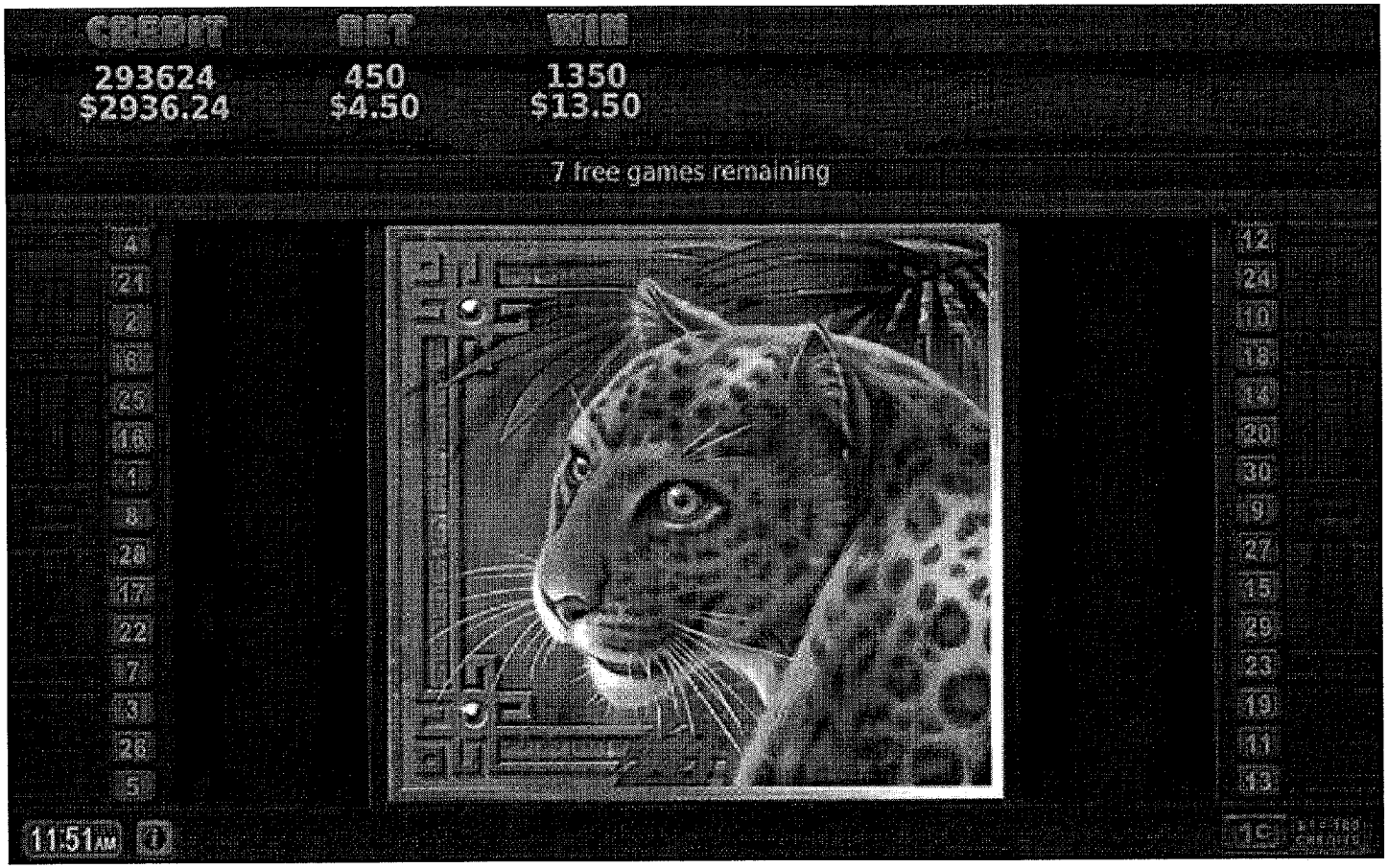
Figure 18:
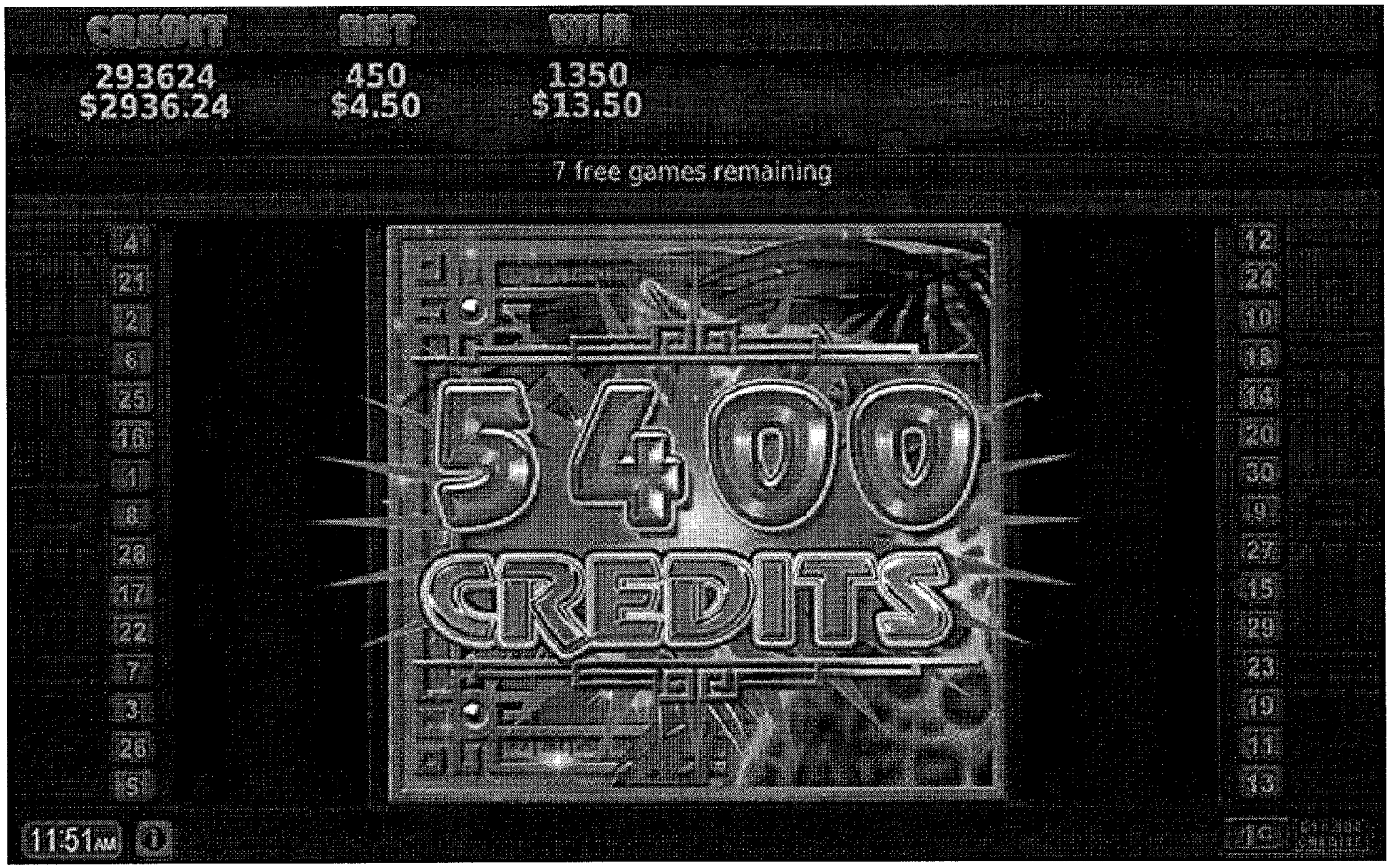

FIGS. 17 and 18 illustrate the block pay win. In this embodiment, the jaguar symbol is animated to expand over the three-by-three block as shown in FIG. 17. In FIG. 18 the block pay win amount is superimposed over the expanded jaguar symbol. In this case, a three-by-three block of jaguar symbols pays 12 credits for every credit wagered, for a total of 5400 credits (i.e., 12 credits×450 credits=5400 credits). After the block pay win is credited, the vertical stacks are again animated to return to their original positions within the reel arrays.

Figure 19:
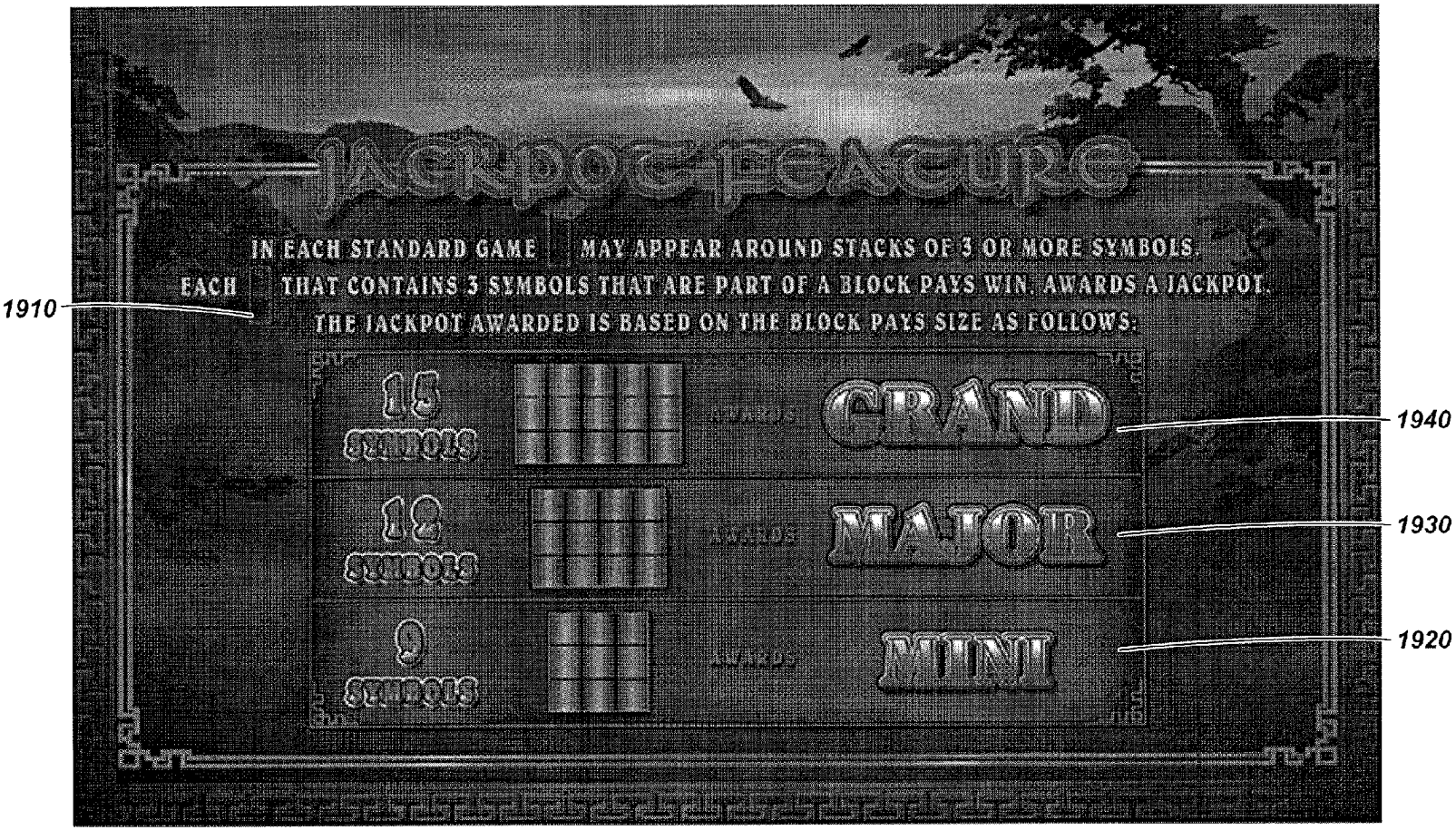
FIG. 19 shows a game display illustrating rules associated with an embodiment of the present disclosure including a jackpot trigger feature for stack frames that may appear at random positions in the game display.

FIG. 19 shows a game display illustrating rules associated with an embodiment of the present disclosure that includes awarding a jackpot prize (also referred to herein as a jackpot award) whenever a special symbol appears in a block pay. In this case, the special symbol is a background symbol in the form of a stack frame 1910 that is applied to stacks of three or more matching symbols. The number of stack frames, their size, and their placement may be randomly determined. The stack frames 1910 may be shown at any time during game play. In one example embodiment, the stack frame 1910 is shown to spin in unison with each symbol stack that it is applied. Alternatively, the stack frame 1910 may only appear on a reel after the reel has stopped spinning and displays a symbol stack that a frame 1910 has been selected to appear on.

A jackpot prize may be triggered for each stack frame 1910 that appears around a symbol stack that is included as part of a block pays win. The jackpot prize may be either a progressive (incrementing) or fixed amount and may include a number of different jackpot "levels." In this embodiment, the level of the jackpot prize awarded is determined by the size of the block pay. For example, a mini jackpot 1920 is triggered if the stack frame 1910 encompasses a stack that is part of a three-by-three block pay. A major jackpot 1930 is triggered if the stack frame 1910 encompasses a stack that is part of a three-by-four block pay. A grand jackpot 1940 is triggered if the stack frame 1910 encompasses a stack that is part of a three-by-five block pay.

Figure 20:
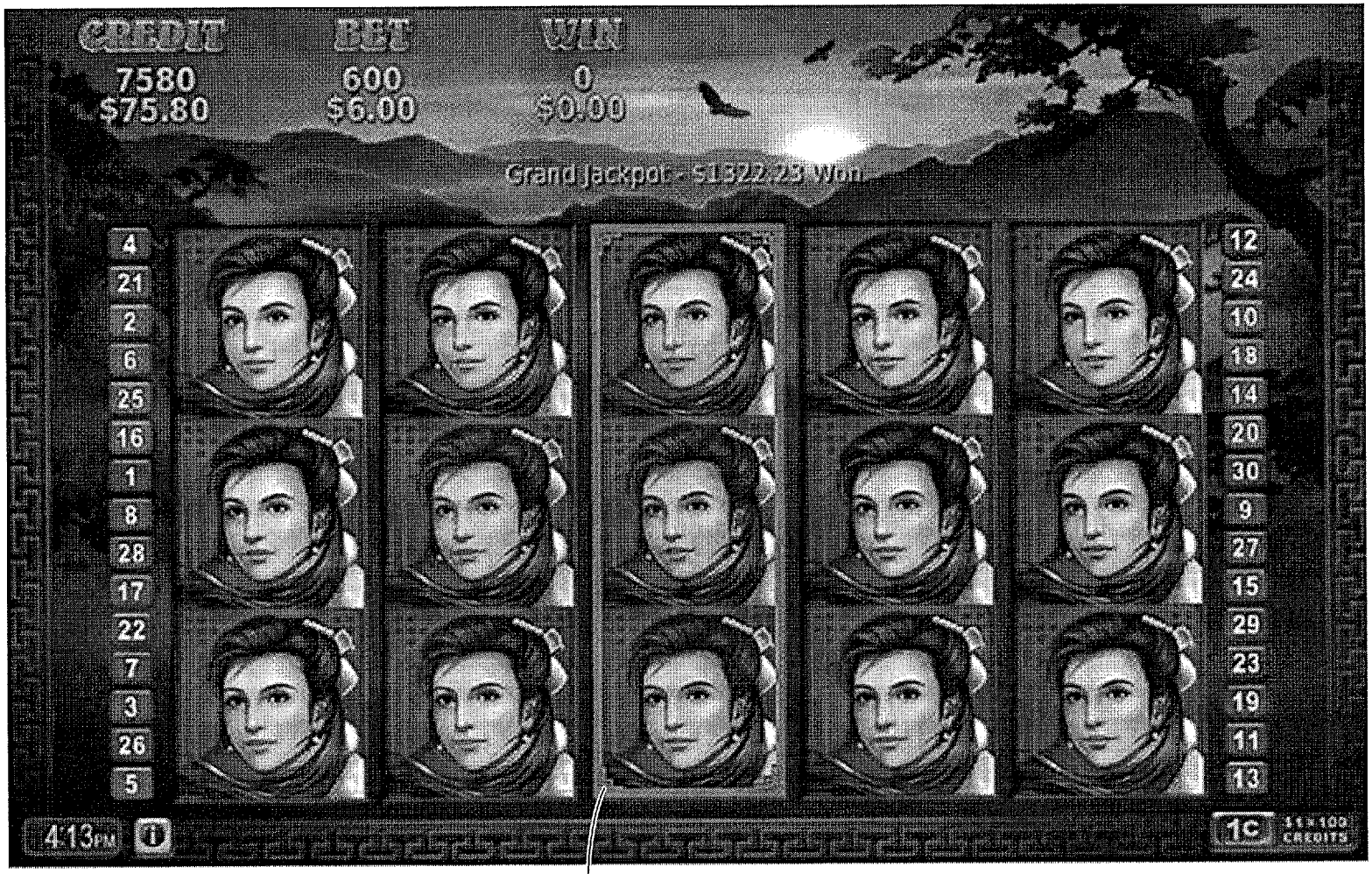
FIGS. 20 and 21 show a sequence of game displays illustrating reel spins resulting in a block pay that includes a jackpot trigger from a displayed stack frame.
Figure 21:
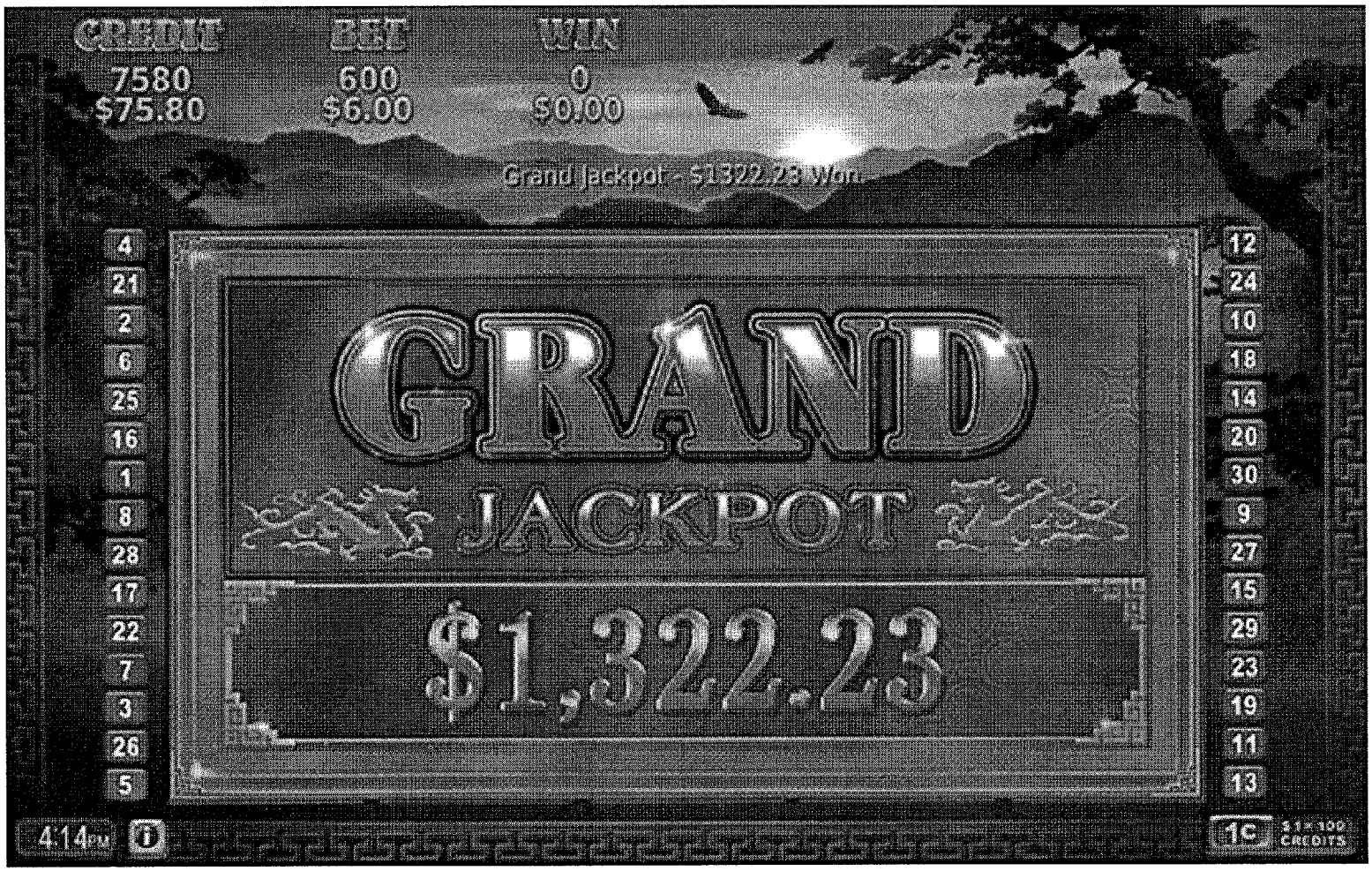

FIGS. 20 and 21 show a sequence of game displays illustrating reel spins resulting in a block pay that includes a jackpot trigger from a displayed stack frame. FIG. 20 shows a standard game at the completion of play in which all 5 reels have stopped spinning. A stack frame 2010 is shown around the three adjacent positions on reel 3. The stack frame 2010 is part of a three-by-five block pay. FIG. 21 indicates that a grand progressive jackpot prize is awarded totaling $1,322.23 as a result of the stack frame 2010 being part of a three-by-five block pay.

Multiple stack frames may be present in any given game play. As a result, multiple jackpots may be awarded. For example, if there was also a stack frame on reel 1 in FIG. 20, an additional grand progressive jackpot prize would have been awarded in accordance to the rules of FIG. 19.

Figure 22:
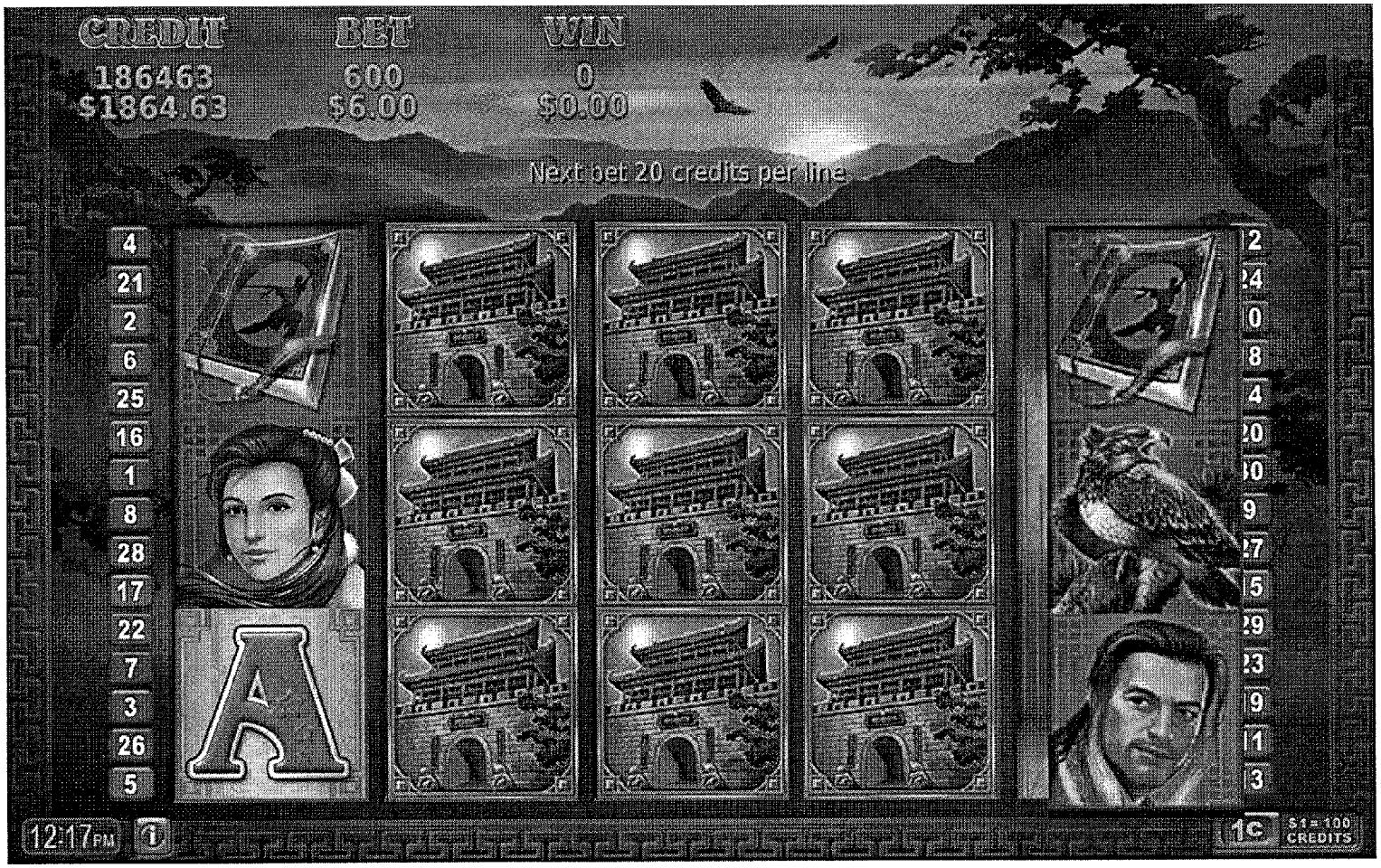
FIGS. 22 and 23 show a sequence of game displays illustrating reel spins resulting in a block pay that includes a jackpot trigger from wild symbols appearing in a block.
Figure 23:
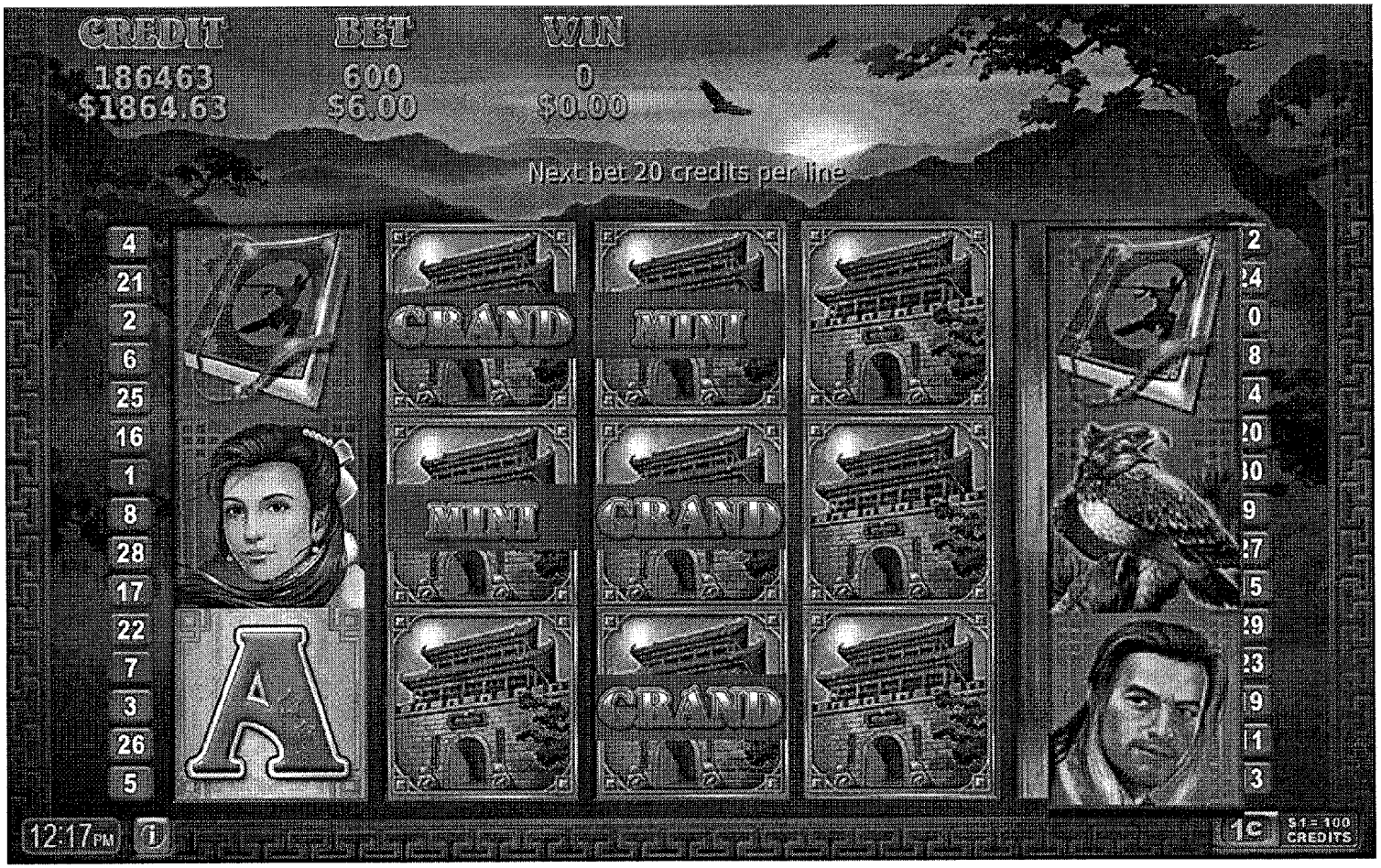

FIGS. 22 and 23 show a sequence of game displays illustrating reel spins resulting in a special symbol forming a block pay that triggers a jackpot feature game. In the present case, the trigger is dependent on a particular type of special symbol (namely, the wild symbol) forming the block pay. Since wild symbols can only appear on reels 2, 3, and 4, the size of the block pay cannot be used to determine the level of jackpot, given that the size is limited to a three-by-three block. As a result, a jackpot feature game is provided to determine the level of the jackpot prize awarded.

FIG. 22 illustrates a block pay with a three-by-three block of the temple symbol 550 as a wild symbol. As a result, the jackpot feature game is triggered.

FIG. 23 shows the result of the jackpot feature game, which begins by allowing the player to pick one of the wild symbols (the temple symbols) to uncover. Each selected wild symbol reveals either one of three different jackpot indicia (i.e., mini, major, and grand). The player keeps picking wild symbols until three of the same jackpot indicia are revealed to win that particular level jackpot for the feature. In FIG. 23, three grand jackpot indicia have been revealed to trigger a grand jackpot.

FIGS. 20 and 21 illustrate an example with a vertical stack frame of three adjacent display positions. However, as with the stacks explained above with reference to FIGS. 4A and 4B, the stack frames may be of different lengths and may run horizontally or vertically.

Moreover, FIGS. 20 and 21 illustrate an example where a jackpot prize is awarded in combination with a block pays award. However, in other embodiments a jackpot prize may be awarded in place of a block pays award.

Figure 24:
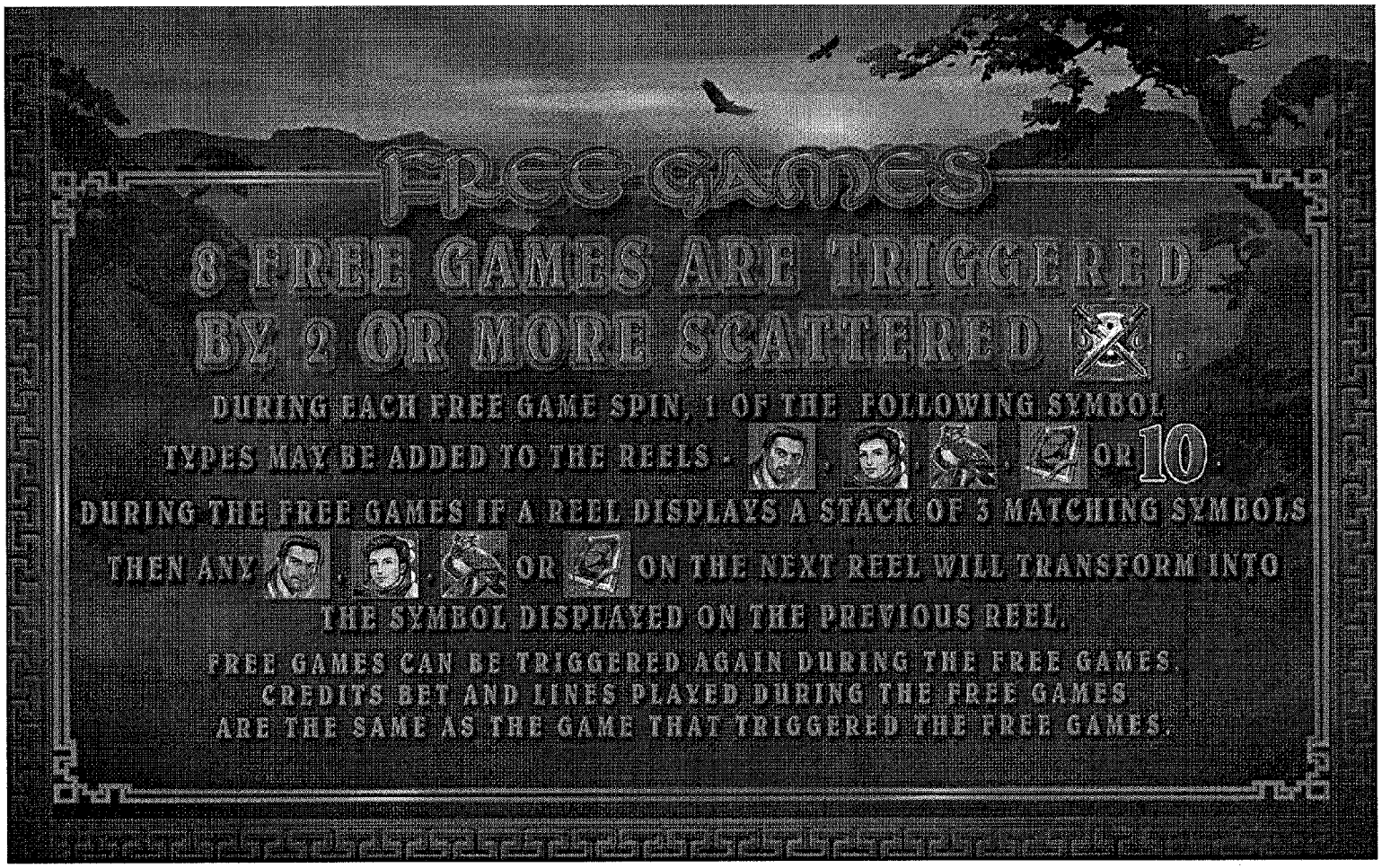
FIG. 24 shows a game display illustrating rules associated with an embodiment of the present disclosure including a symbol transformation feature.

FIG. 24 shows a game display illustrating rules associated with an embodiment of the present disclosure including a symbol transformation feature. One rule of the game indicates that if a reel displays a matching symbol in all three vertical positions, then some symbols in the next reel are eligible to be transformed. In this case, the major symbols (the eagle symbol 522, the book symbol 524, the lady symbol 526, and the hero symbol 528) are all transformation eligible symbols. These symbols, if they appear on the next reel are transformed to the symbol that appeared on all three positions of the previous reel. While defined for free games in the rules of FIG. 23, in other embodiments, this symbol transformation feature may be used in standard games as well as free games.

Figure 25:
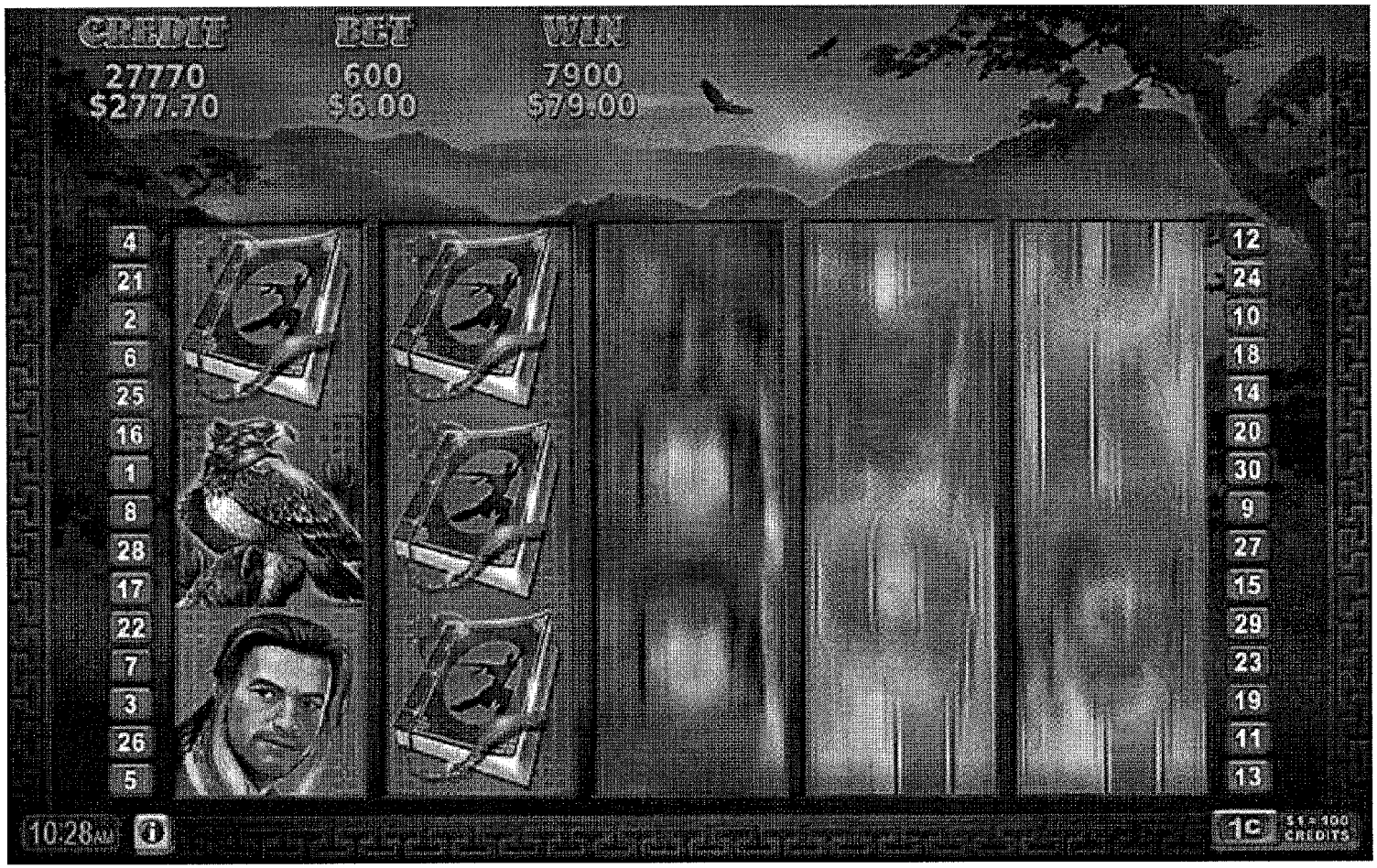
FIGS. 25-30 show a sequence of game displays illustrating reel spins illustrating the symbol transformation feature.

FIGS. 25-30 show a sequence of game displays illustrating reel spins providing a symbol transformation feature. FIG. 25 shows a free game round currently in play where reels 1 and 2 have stopped spinning, while reels 3, 4 and 5 remain spinning. Reel 2 includes the book symbol 524 in all three vertical display positions. This configuration may be referred to as a matching reel and the symbols within the matching reel may be referred to as reel matched symbols.

While not shown in the screen shot, a free spins counter may be provided to indicate the number of free spins remaining. Given that each free game round is considered by gaming regulators to be a single "play" of the game, regardless of the number of free spins it provides, all credits won during each free spin are accumulated on the WIN meter and are added to the CREDIT meter at the completion of the round. During the free game round, the number of paylines selected and bet per line remains the same as the standard game that triggered the free game round such that the BET meter remains at 600 credits (i.e., $6.00) throughout the free game round, though this amount is not taken off the CREDIT meter for each spin in the round.

Figure 26:
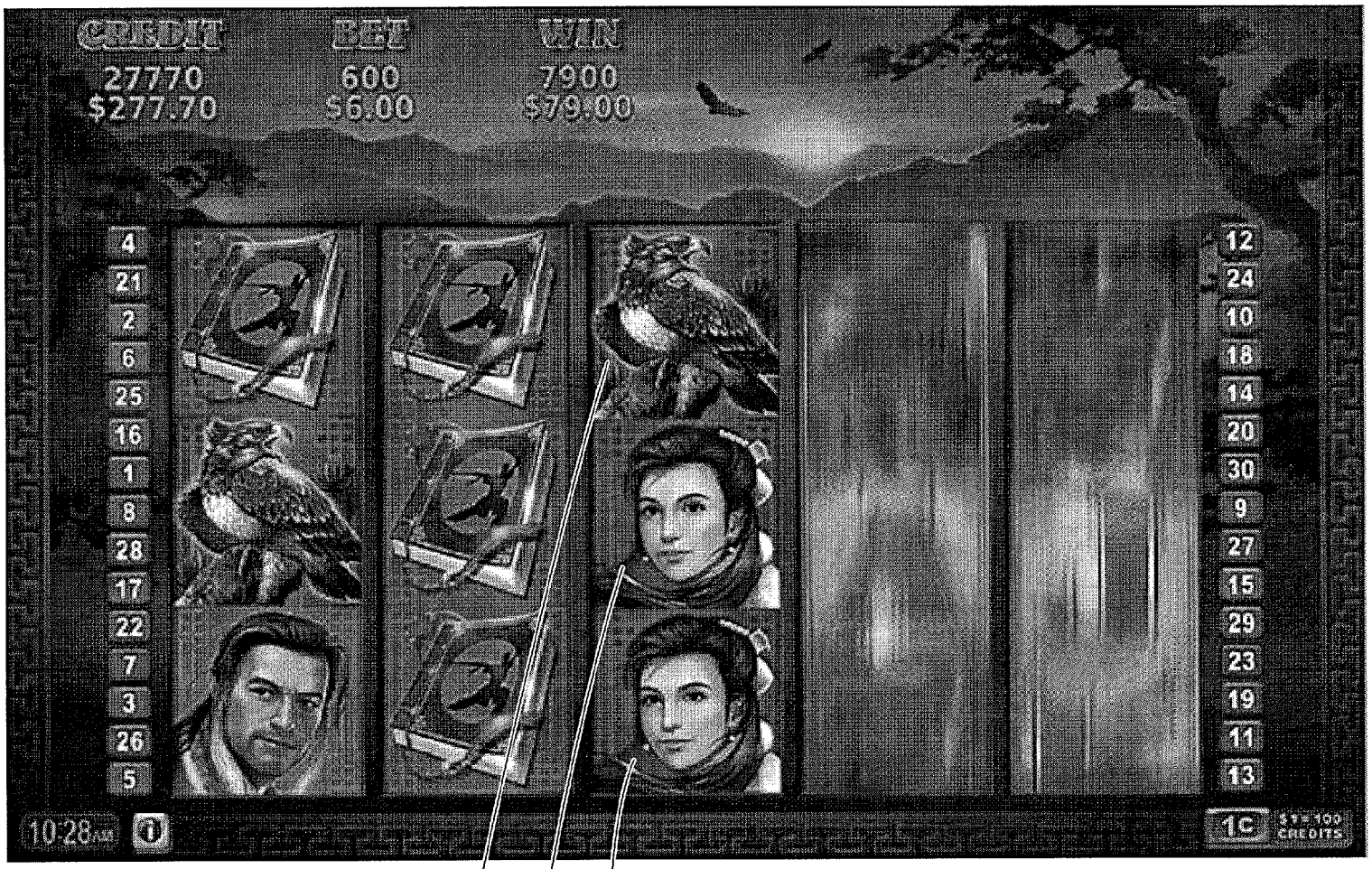

FIG. 26 shows reel 3 has now stopped, while reels 4 and 5 remain spinning. Since reel 2 stopped on a stack of symbols (in this case, the book symbol 524), any symbols that are transformation eligible symbols appearing on reel 3 will be transformed to the same type of symbol that appears in the stack of reel 2 (i.e., the book symbol 524). Display position 2610 includes the eagle symbol 522, which is a transformation eligible symbol. Display positions 2620 and 2630 each include the lady symbol 526, which is a transformation eligible symbol.

Figure 27:
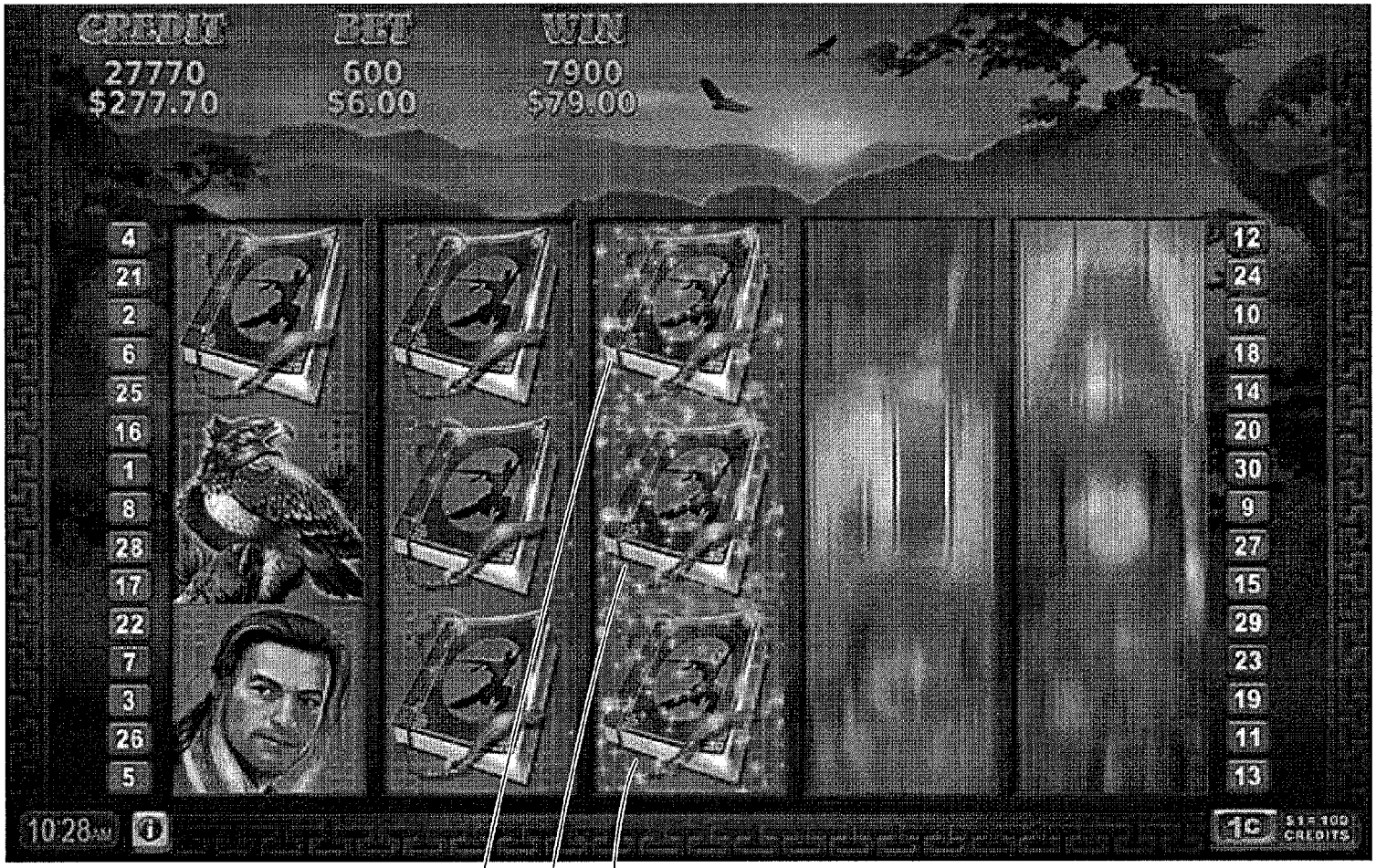

FIG. 27 shows a frame of an animation sequence of the three transformation eligible symbols on display positions 2710, 2720, and 2730 on reel 3 transforming from their original symbol to the book symbol 524 to match the book symbols 524 in reel 2. Reels 4 and 5 are shown as still spinning.

Figure 28:
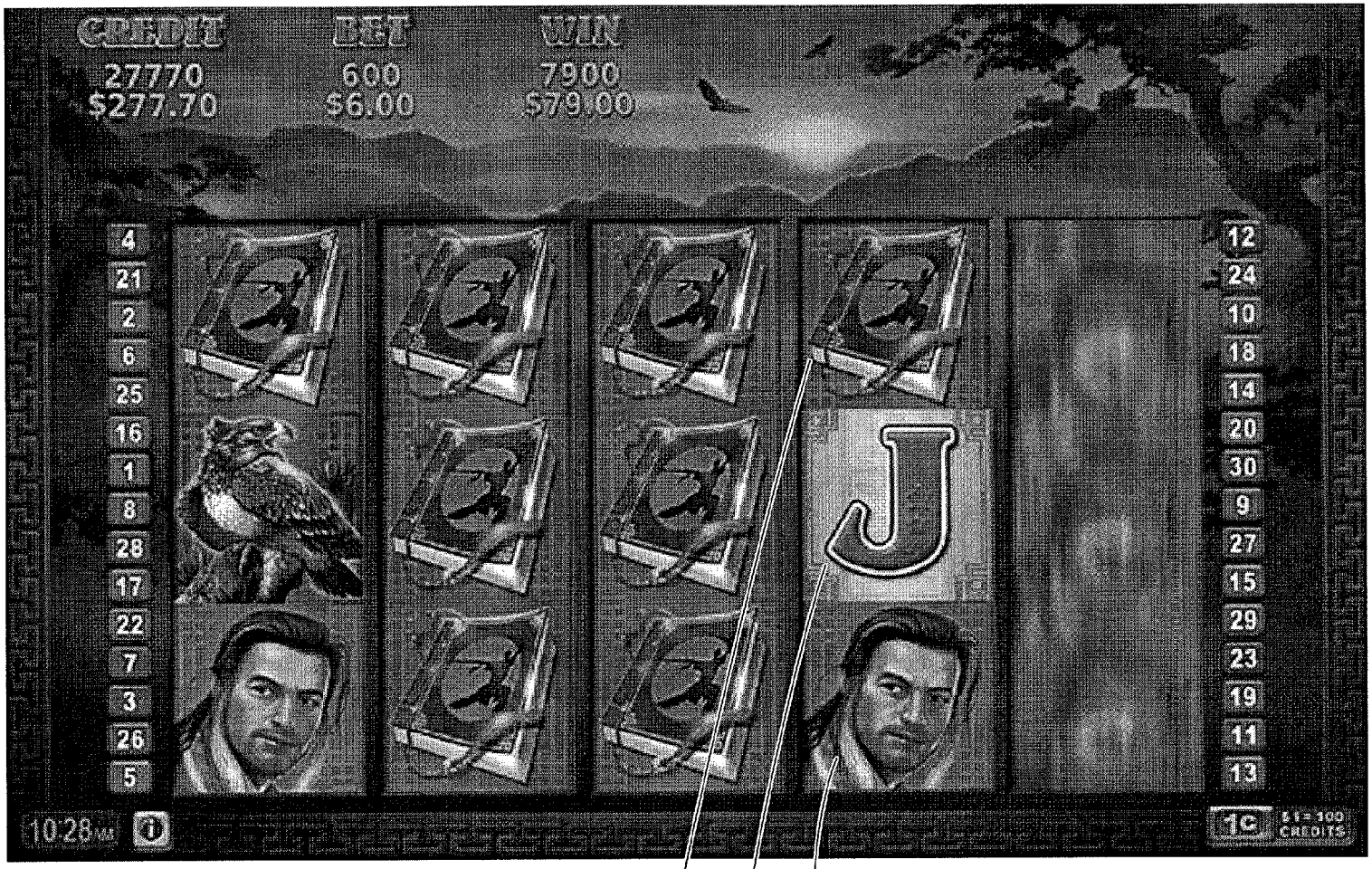

FIG. 28 shows that reel 4 has stopped and includes a book symbol 524 at display position 2810, a jack symbol 512 at display position 2820, and a hero symbol 528 at display position 2830. The book symbol 524 is a transformation eligible symbol. However, there is no need to transform the book symbol 524 at display position 2810 because it already matches the book symbols 524 on reel 3. The jack symbol 512 at display position 2820 is not a transformation eligible symbol. The hero symbol 528 at display position 2830 is a transformation eligible symbol.

Figure 29:
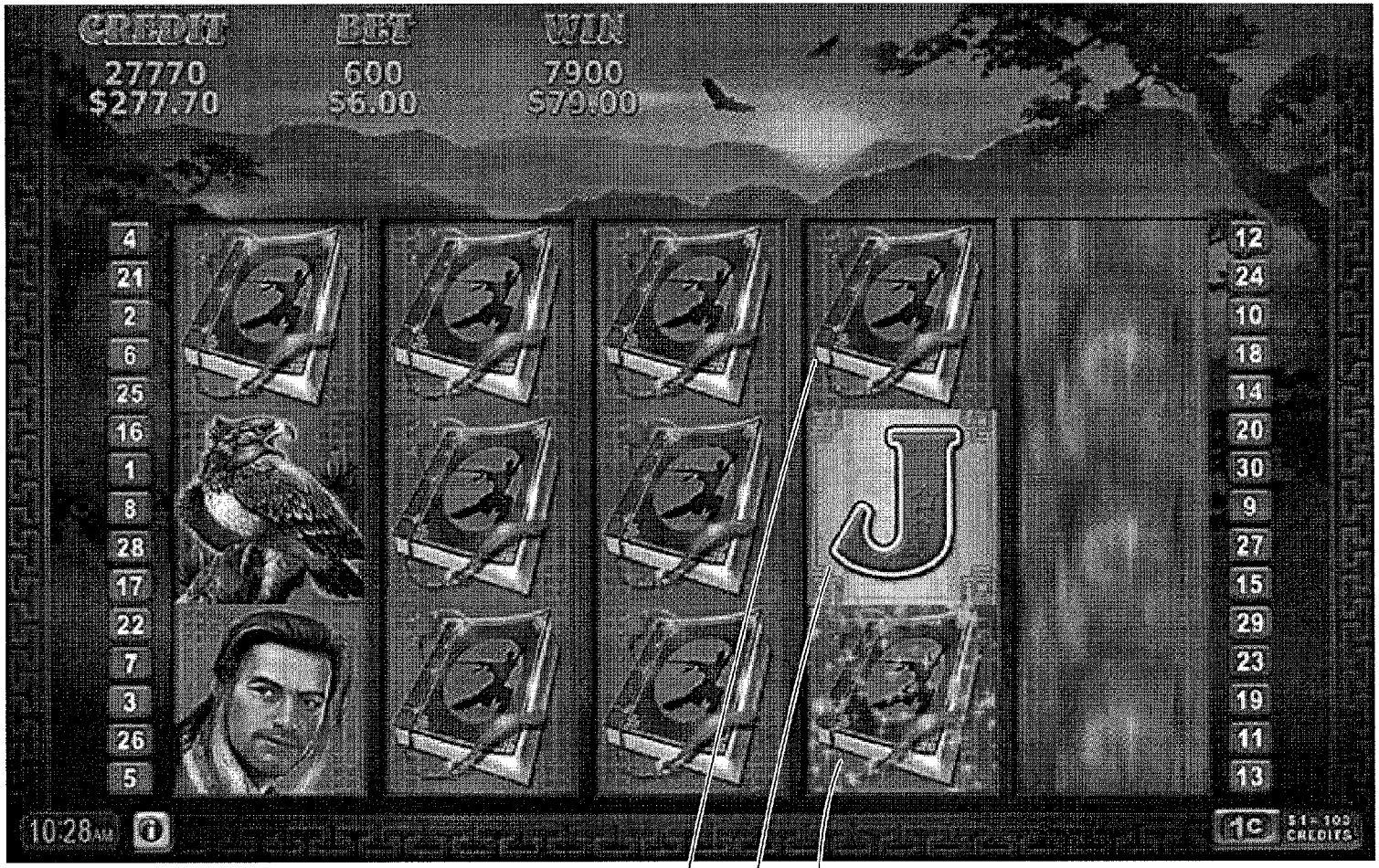

FIG. 29 shows an animation of the hero symbol 528 transforming to a book symbol 524 at display position 2930. The book symbol 524 at display position 2910 and the jack symbol 512 at display position 2920 are left as they were when reel 4 stopped spinning.

Figure 30:
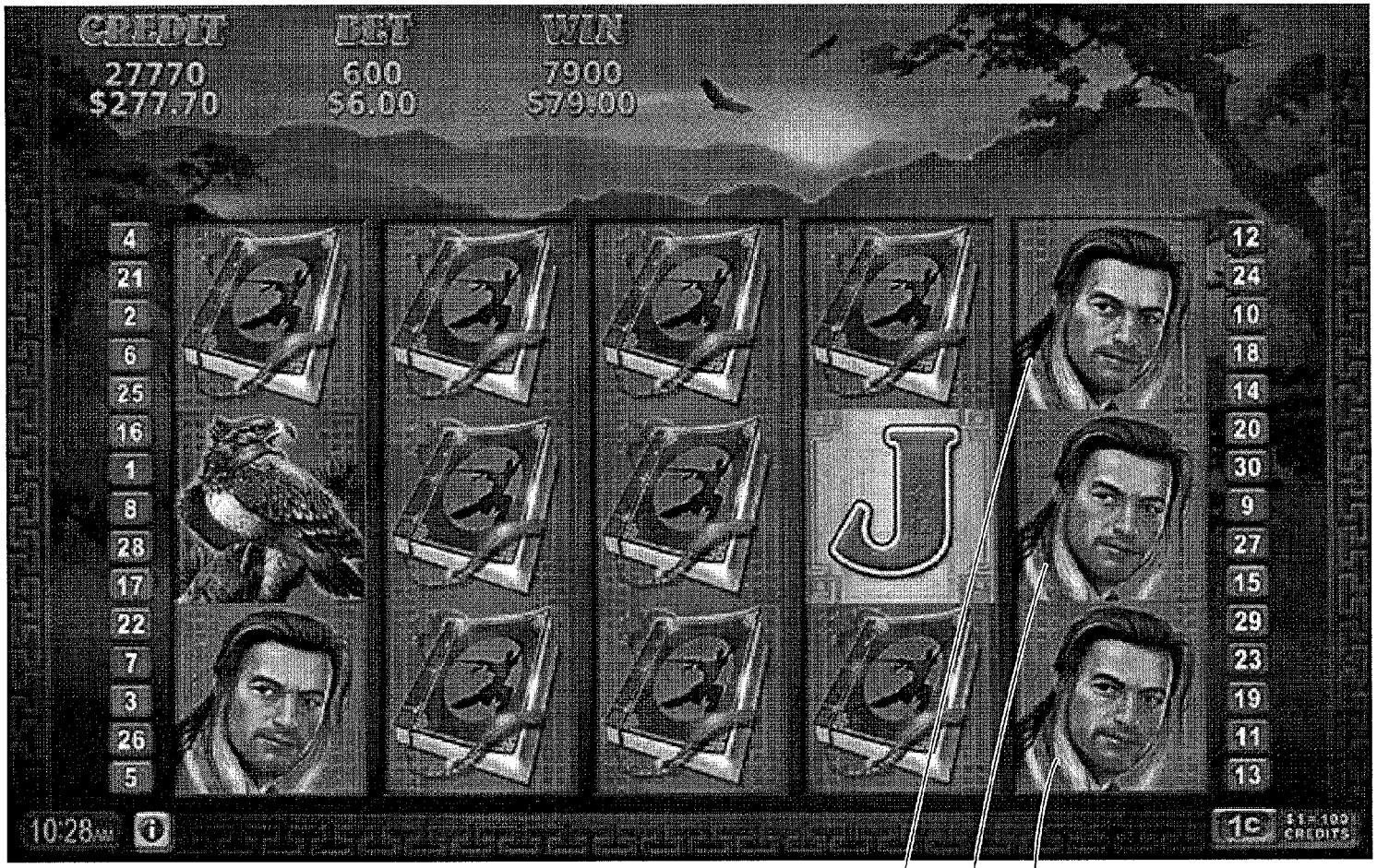

FIG. 30 shows that reel 5 has stopped and includes hero symbol 528 at display positions 3010, 3020, and 3030. The hero symbol 528 is a transformation eligible symbol. However, since not all the symbols in reel 4 match, the symbols in reel 5 are not transformed.

Figure 31:
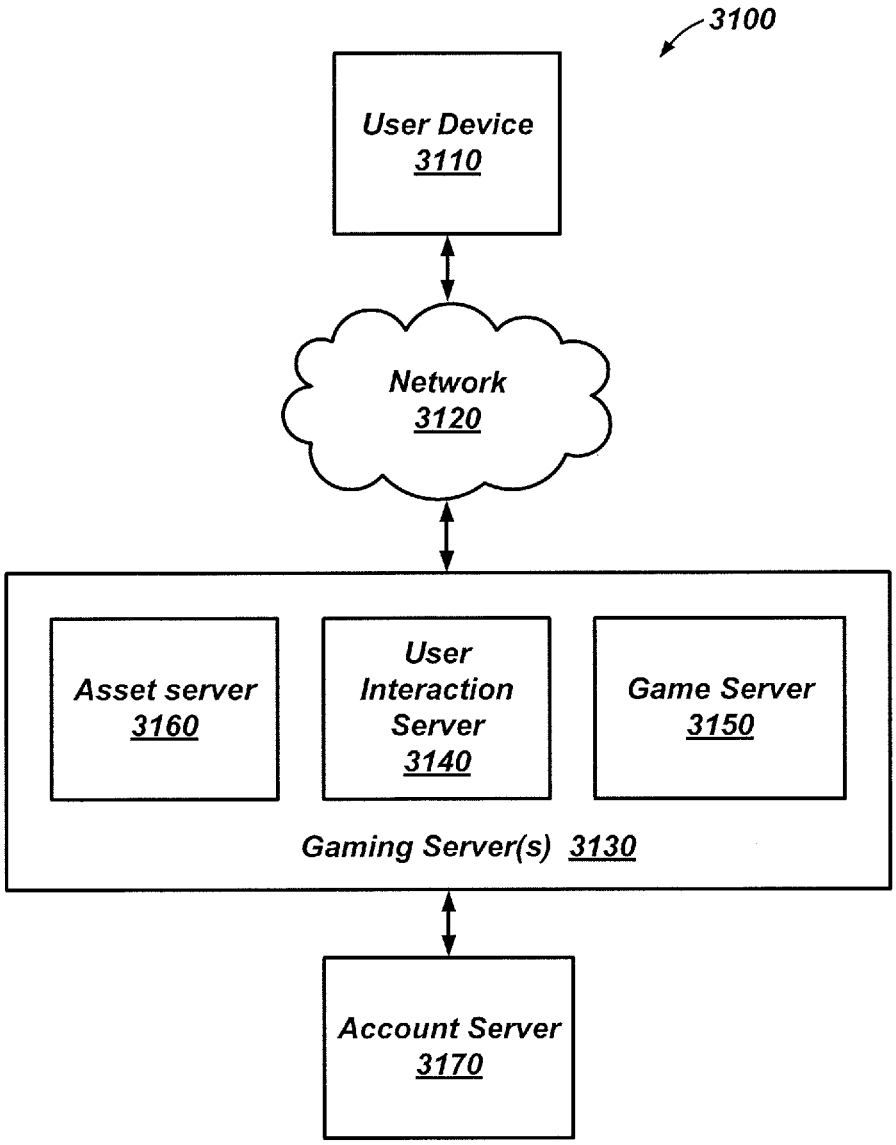
FIG. 31 is a simplified block diagram of a gaming system with a user device and one or more gaming servers.

FIG. 31 is a simplified block diagram of a gaming system 3100 with a user device 3110 and one or more gaming servers 3130. While the disclosure thus far has concentrated on an electronic gaming machine 100 (FIGS. 1 and 2), embodiments may also be configured for the gaming system 3100 with distributed execution over a network 3120, such as, for example, the Internet or other suitable local area network or wide area network. FIG. 31 illustrates a client-server type architecture with a user device 3110 as a client communicating with the gaming servers 3130 over the network 3120.

The gaming system 3100 enables players to use a user device 3110 to access the one or more gaming servers 3130 through the network 3120 in order to access proprietary game content, non-proprietary game content, and a combination thereof. Such game content may include, without limitation, various types of wagering games where the game outcome is determined, in whole or in part, by one or more random events.

The wagering games supported by the gaming system 3100 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This variation may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 3100 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (i.e., the person or entity controlling the hosting systems).

The gaming servers 3130 may be configured as a single server including the functions for practicing embodiments of the present disclosure in combination with the user device 3110. In other embodiments, the gaming servers 3130 may be configured as separate servers for performing certain functions. As shown in FIG. 31, the gaming servers 3130 may include a user interaction server 3140, a game server 3150, and an asset server 3160. In some embodiments, one or more of the gaming servers 3130 may communicate with an account server 3170. Description herein concentrates on the multi-server embodiment illustrated in FIG. 31. However, a person of ordinary skill in the art will understand that the functions of various servers may be combined and separated into various different physical and virtual servers. As a result, this description also discusses the "server" as a "service" with the understanding that the service may be performed by different servers or combinations of servers in different embodiments.

The user device 3110 may communicate with the user interaction service 3140 using the network 3120. The user interaction service 3140 may communicate with the game service 3150 and provide game information to the user device 3110. In some embodiments, the game service 3150 includes a game engine for determining the random events and specific layouts of symbols related to the specific game and game rules. In some embodiments, a plurality of end users may be permitted to access a single user interaction service 3140, or there may be a plurality of user interaction services 3140 (e.g., one for each user), to access the game service 3150.

As non-limiting examples, the user interaction service 3140 may communicate with the user device 3110 to enable a user to create and access a user account and interact with gaming servers 3130. The user interaction service 3140 may enable users to initiate new games, join existing games, and interface with games being played by the user.

The user interaction service 3140 may also provide a client for execution on the user device 3110 for accessing the gaming servers 3130. The client provided by the gaming servers 3130 for execution on the user device 3110 can comprise a variety of implementations according to the user device 3110 and method of communication with the gaming servers 3130. In one embodiment, the user device 3110 connects to the gaming servers 3130 using a web browser, and the client executes within a browser window or frame of the web browser. In another embodiment, the client is a stand-alone executable on the user device 3110.

In one embodiment, the client may comprise a relatively small amount of script (e.g., JAVASCRIPT®), also referred to as a "script driver," including scripting language that controls an interface of the client. The script driver may include simple function calls requesting information from the gaming servers 3130. In other words, the script driver stored in the client may merely include calls to functions that are externally defined by, and executed by, the gaming servers 3130. As a result, the client may be characterized as a "thin client." As that term is used herein, the client may be little more than a script player. The client may simply send requests to the gaming servers 3130 rather than performing logic itself. The client receives player inputs, and the player inputs are passed to the gaming servers 3130 for processing and executing the wagering game. In one embodiment, this includes providing specific graphical display information to client as well as game outcomes. As more specific examples, the client may simply display the reels used in the game as sent to it from the gaming servers 3130. In others, the client may have the ability to show animations discussed above such as, for example, the spinning reels and animations associated with a game result.

In other embodiments, the client comprises an executable file rather than a script. In these cases, the client may do more local processing than does a script driver, such as calculating where to show what game symbols upon receiving a game outcome from the gaming servers 3130. Due to security and integrity concerns, most embodiments will have the bulk of the processing of the game play performed at the gaming servers 3130. However, some embodiments may include significant game processing by the client when the user device 3110 is considered trustworthy or when there is reduced concern for security and integrity in the displayed game outcomes. In most embodiments, it is expected that some form of data protection, such as end-to-end encryption, will be used when data is transported over the network 3120.

The gaming servers 3130 may include an asset service 3160, which may host various media assets (e.g., audio, video, and image files) that may be sent to the user device 3110 for presenting the various wagering games to the end user. In other words, the assets presented to the end user may be stored separately from the user device 3110. In one embodiment, the user device 3110 requests the assets appropriate for the game played by the user; in other embodiments, especially those using thin clients, just those assets that are needed for a particular display event will be sent by the gaming servers 3130 when the game service 3150 determines they are needed, including as few as one asset. In one example, the user device 3110 may call a function defined at the user interaction service 3140 or asset service 3160 to determine which assets are to be delivered to the user device 3110 as well as how the assets are to be presented by the user device 3110 to the end user.

The gaming servers 3130 may include the game service 3150, which may be configured to perform game play methods and determine game play outcomes that are provided to the user interaction service 3140 to be transmitted to the user device 3110 for display. For example, the game service 3150 may include game rules for one or more wagering games, such that the game service 3150 controls some or all of the game flow and game rules for a selected wagering game as well as the determined game outcomes. The game service 3150 may include pay tables and other game logic. The game service 3150 also performs random number generation for determining random game elements of the wagering game. In some embodiments, the game service 3150 is separated from the user interaction service 3140 by a firewall or other method of preventing unauthorized access to the game service 3150 from other general members of the network 3120.

The user device 3110 may present a gaming interface to the player and communicate the user interaction to the gaming servers 3130. The user device 3110 may be any electronic system capable of displaying gaming information, receiving user input, and communicating the user input to the gaming servers 3130. As such, the user device 3110 can be a desktop computer, a laptop, a tablet computer, a set-top box, a mobile device (including, but not limited to, a smart phone), a kiosk, a terminal, or another computing device.

In one embodiment, the gaming system 3100 may be operated by different entities. The user device 3110 may be operated by a third party, such as a casino or an individual, that links to the gaming servers 3130, which may be operated, for example, by a wagering game service provider. Therefore, in some embodiments, the user device 3110 and client may be operated by a different administrator than the operator of the gaming servers 3130. In other words, the user device 3110 may be part of a third-party system that does not administer or otherwise control the gaming servers 3130. In another embodiment, the user interaction service 3140 and asset service 3160 are provided by a third-party system. For example, a gaming entity (e.g., a casino) may operate the user interaction service 3140, user device 3110, or combination thereof to provide its customers access to game content managed by a different entity that may control the gaming servers 3130, amongst other functionality. In some embodiments, these functions are operated by the same administrator.

The gaming servers 3130 may communicate with one or more external account servers 3170 (also referred to as an account service 3170, optionally through another firewall. For example, the gaming servers 3130 may not directly accept wagers or issue payouts. That is, the gaming servers 3130 may facilitate online casino gaming but may not be part of a self-contained online casino itself. Instead, the gaming servers 3130 may facilitate the play of wagering games owned and controlled by a company offering games and gaming products and services, such Bally Technologies, Inc. Another entity (e.g., a casino or any account holder or financial system of record) may operate and maintain its external account service 3170 to accept bets and make payout distributions. The gaming servers 3130 may communicate with the account service 3170 to verify the existence of funds for wagering and to instruct the account service 3170 to execute debits and credits.

In some embodiments, the gaming servers 3130 may directly accept bets and make payout distributions, such as in the case where an administrator of the gaming servers 3130 operates as a casino. In addition, for play-for-fun wagering games, the gaming servers 3130 may issue credits, take bets, and manage the balance of the credits according to the game outcomes, but the gaming servers 3130 may not permit payout distributions or be linked to an account service 3170 that permits payout distributions. Such credits may be issued for free, through purchase, or for other reasons, without the ability for the player to cash out. Such play-for-fun wagering games may be administered on platforms that do not permit traditional gambling, such as to comply with jurisdictions that do not permit online gambling.

The gaming servers 3130 may be configured in many ways, from a fully integrated single system to a distributed server architecture. The gaming servers 3130 and asset service 3160 may be configured as a single, integrated system of code modules running on a single server or machine, where each of the servers is functionally implemented on a single machine. In such a case, the functionality described herein may not be implemented as separate code modules. The gaming servers 3130 and asset service 3160 may also be implemented as a plurality of independent servers, each using its own code modules running on a separate physical machine, and may further include one or more firewalls between selected servers (depending on security needs). Each server could communicate over some kind of networked connection, potentially as varied as that described for the network 3120. Further, each single server shown in FIG. 31 may be implemented as a plurality of servers with load balancing and scalability factors built into the embodiment. All such embodiments and variations are fully contemplated.

Additional features may be supported by the gaming servers 3130, such as hacking and cheating detection, data storage and archival, metrics generation, messages generation, output formatting for different end user devices, as well as other features and operations.

The network 3120 enables communications between the user device 3110 and the gaming servers 3130. The same network 3120 or a different network (not shown), which may be a secure network, may also connect the gaming servers 3130 and account service 3170. In one embodiment, the network 3120 uses standard communications technologies and/or protocols. Thus, the network can include links using technologies such as Ethernet, 802.11, worldwide interoperability for microwave access (WIMAX®), 3G, digital subscriber line (DSL), asynchronous transfer mode (ATM), INFINIBAND®, PCI Express Advanced Switching, BLUETOOTH®, ZIGBEE®, etc. Similarly, the networking protocols used on the network 3120 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 3120 can be represented using technologies and/or formats including the hypertext markup language (HTML), the extensible markup language (XML), etc. In addition, all or some of the links can be encrypted using conventional encryption technologies such as secure sockets layer (SSL), transport layer security (TLS), virtual private networks (VPNs), Internet Protocol security (IPsec), etc.

In another embodiment, the entities can use custom or dedicated data communications technologies instead of, or in addition to, the ones described above. Depending upon the embodiment, the network 3120 can include links comprising one or more networks such as the Internet.

Figure 32:
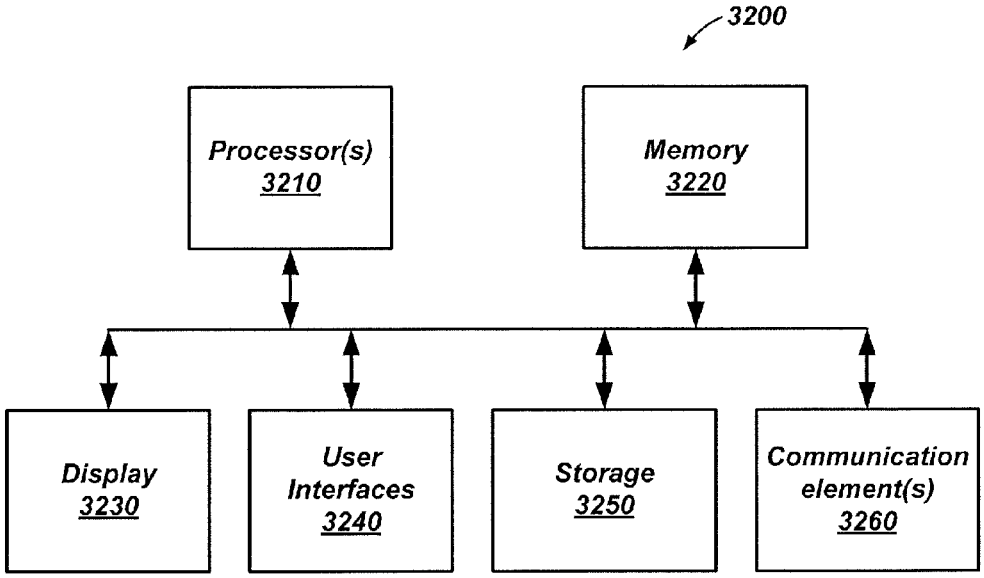
FIG. 32 is a simplified block diagram showing elements of computing devices that may be used in embodiments of the present disclosure.

FIG. 32 is a simplified block diagram showing elements of computing devices that may be used in embodiments of the present disclosure.

The computing system 3200 may be a user-type computer, a file server, a compute server, a notebook computer, a tablet, a handheld device, a mobile device, or other similar computer system for executing software. Computer, computing system, mobile device, and server may be used interchangeably herein to indicate a system that might practice a portion or all of the processes of the present disclosure. The computing system 3200 is configured for executing software programs containing computing instructions and may include one or more processors 3210, memory 3220, one or more displays 3230, one or more user interface elements 3240, one or more communication elements 3260, and storage 3250.

The processors 3210 may be configured for executing a wide variety of operating systems and applications including the computing instructions for carrying out embodiments of the present disclosure.

The memory 3220 may be used to hold computing instructions, data, and other information for performing a wide variety of tasks including performing embodiments of the present disclosure. By way of example, and not limitation, the memory 3220 may include Synchronous Random Access Memory (SRAM), Dynamic RAM (DRAM), Read-Only Memory (ROM), Flash memory, and the like.

The display 3230 may be a wide variety of displays such as, for example, light emitting diode displays, liquid crystal displays, cathode ray tubes, and the like. In addition, the display 3230 may be configured with a touchscreen feature for accepting user input as a user interface element 3240.

As non-limiting examples, the user interface elements 3240 may include elements such as displays, keyboards, mice, joysticks, haptic devices, microphones, speakers, cameras, and touchscreens.

As non-limiting examples, the communication elements 3260 may be configured for communicating with other devices or communication networks. As non-limiting examples, the communication elements 3260 may include elements for communicating on wired and wireless communication media, such as, for example, serial ports, parallel ports, Ethernet connections, universal serial bus (USB) connections, IEEE 1394 ("firewire") connections, THUNDERBOLT™ connections, BLUETOOTH® wireless networks, ZIGBEE® wireless networks, 802.11 type wireless networks, cellular telephone/data networks, and other suitable communication interfaces and protocols.

The storage 3250 may be used for storing relatively large amounts of non-volatile information for use in the computing system 3200 and may be configured as one or more storage devices. By way of example, and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

FIG. 32 is intended for discussing a simplified version of a computing system 3200. A person of ordinary skill in the art will recognize that the computing system 3200 may be configured in many different ways with different types of interconnecting buses between the various elements. Moreover, the various elements may be subdivided physically, functionally, or a combination thereof. As one non-limiting example, the memory 3220 may be divided into cache memory, graphics memory and main memory. Each of these memories may communicate directly or indirectly with the one or more processors 3210 on separate buses, partially-combined buses, or a common bus.

Software processes described herein are intended to illustrate representative processes that may be performed by the systems described herein. Unless specified otherwise, the order in which the process acts are described is not intended to be construed as a limitation, and acts that may be described as occurring sequentially for ease of description may occur in a different sequence, occur concurrently, occur concurrently on multiple hardware platforms, or occur in one or more parallel process streams. It will be appreciated by those of ordinary skill in the art that many acts and processes may occur in addition to those outlined in flowcharts. Furthermore, the processes may be implemented in any suitable hardware, software, firmware, or combinations thereof. When executed as firmware or software, the instructions for performing the processes may be stored on a computer-readable medium and hardware executing the processes should be considered as special purpose hardware configured for carrying out processes described herein.

By way of non-limiting example, computing instructions for performing the processes may be stored on the storage 3250, transferred to the memory 3220 for execution, and executed by the processors 3210. The processors 3210, when executing computing instructions configured for performing the processes, constitute structure for performing the processes and can be considered as a special-purpose computer when so configured. In addition, some or all portions of the processes may be performed by hardware specifically configured for carrying out the processes.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality.

While particular embodiments of this disclosure have been described, it will be evident to those skilled in the art that the present invention may be embodied in other specific forms without departing from the essential characteristics thereof. The present embodiments and examples are, therefore, to be considered in all respects as illustrative and not restrictive, and all modifications that would be obvious to those skilled in the art are, therefore, intended to be embraced therein. The invention as disclosed herein is encompassed by, and only limited by, the claims which follow, including legal equivalents.

It will be understood that the invention disclosed and defined herein extends to all alternative combinations of two or more of the individual features mentioned or evident from the text. All of these different combinations constitute various alternative aspects of the invention.

What is claimed is:

1. A computer implemented method of administering game play for a gaming system, the gaming system including one or more game-logic circuitry and a gaming machine primarily dedicated to playing at least one wagering game, the gaming machine including an electronic display device and one or more electronic input devices, the method comprising:

detecting, via at least one of the one or more electronic input devices, a physical item associated with a monetary value that establishes a credit balance;

initiating the at least one casino wagering game in response to an input indicative of a wager covered by the credit balance;

displaying an electronic reel simulation including a multiple reel array for the at least one wagering game on a game display of the gaming machine of the gaming system;

determining, using the game-logic circuitry, a game outcome and causing the game outcome to be presented on the game display, the game outcome comprising a plurality of symbols for an array of displayed positions of the multiple reel array;

defining, before game play of the at least one wagering game and without player input, one or more block arrangements used for evaluating qualification of the game outcome for a block pay win, wherein each block arrangement comprises two or more stacks of a same size within the array, each stack comprises two or more adjacent positions along a first direction within the array, each stack occupies a different position within the array in a second direction perpendicular to the first direction, and all of the two or more stacks are aligned in the second direction, wherein symbols presented on the game display including within the one or more block arrangements within the array are each independently selected randomly from each other;

determining, using the game-logic circuitry, one or more winning combinations of the symbols according to payout ways rules, wherein each winning combination comprises two or more matching symbols appearing in the displayed positions in combinations of payout ways predefined before the game play;

determining, using the game-logic circuitry, whether the one or more block arrangements include a winning block that qualifies for a block pay win according to block pay rules that are different than the payout ways rules, wherein the block pay win is achieved if matching symbols appear in displayed positions corresponding with the one or more block arrangements;

issuing an award responsive to determining the one or more winning combinations of the symbols determined by the payout ways rules;

issuing another award responsive to determining the one or more winning blocks determined by the block pay rules, wherein a size of a payout for the another award depends, at least in part, on a size of the winning block determined by the game-logic circuitry; and receiving, via at least one of the one or more electronic input devices, a cashout input that initiates a payout from the credit balance.

2. The method of claim 1, wherein defining the one or more block arrangements further comprises defining that the two or more stacks are adjacent in the second direction.

3. The method of claim 1, wherein defining the one or more block arrangements further comprises defining that the two or more stacks include at least one stack that is not adjacent with another stack of the two or more stacks.

4. The method of claim 3, wherein determining the one or more winning blocks further comprises presenting on the game display an animation of the two or more stacks moving together to form a block of the matching symbols that are adjacent in both the first direction and the second direction.

5. The method of claim 1, wherein determining a game outcome further comprises, prior to determining one or more winning blocks:

determining a matching reel as a reel that has stopped wherein all display positions on the matching reel include a matching symbol as a reel matched symbol; and on a next reel adjacent to the matching reel, transforming symbols that are transformation eligible symbols to the reel matched symbol.

6. The method of claim 1, wherein defining the one or more block arrangements comprises defining one or more of a three-by-three block arrangement, a three-by-four block arrangement, and a three-by-five block arrangement.

7. The method of claim 1, wherein:

displaying the electronic reel simulation on the game display is performed by a user device including the game display; and the acts of determining the game outcome, defining the one or more block arrangements, determining the one or more winning combinations, and determining the one or more winning blocks are performed by one or more gaming server in communication with the user device through a network.

8. The method of claim 1, wherein the operations are performed on a stand-alone gaming machine.

9. A gaming system, comprising:

a gaming machine primarily dedicated to playing at least one wagering game, the gaming machine including:

a game display;

one or more electronic input devices; and processing circuitry operably coupled to the game display and the one or more electronic input devices, the processing circuitry configured to cause the gaming system to:

detect, via at least one of the one or more electronic input devices, a physical item associated with a monetary value that establishes a credit balance;

initiate the at least one wagering game in response to an input indicative of a wager covered by the credit balance;

display an electronic reel simulation of the at least one wagering game on the game display, the electronic reel simulation including a multiple reel array;

determine a game outcome and causing the game outcome to be presented on the game display, the game outcome comprising a plurality of symbols for an array of displayed positions of the multiple reel array;

define, before a game play and without player input, one or more block arrangements used for evaluating qualification of the game outcome for a block pay win, wherein each block arrangement comprises two or more stacks of a same size within the array, each stack comprises two or more adjacent positions along a first direction within the array, each stack occupies a different position within the array in a second direction perpendicular to the first direction, and all of the two or more stacks are aligned in the second direction, wherein symbols displayed including the block arrangements within the multiple reel array are each independently selected randomly from each other;

determine any winning combinations of the symbols according to payout ways rules, wherein each winning combination comprises two or more matching symbols appearing in the displayed positions in combinations of payout ways predefined before the game play;

determine the block pay win based on one or more winning blocks being determined in the game outcome according to block pay rules that are different from the payout ways rules, wherein each of the one or more winning blocks comprise matching symbols appearing in displayed positions corresponding with the one or more block arrangements;

issue an award responsive to determination of any winning combination of symbols;

issue another award responsive to determination of one or more winning blocks, wherein a size of a payout for the another award depends, at least in part, on a size of each of the one or more winning blocks determined by the processing circuitry; and receive, via at least one of the one or more electronic input devices, a cashout input that initiates a payout from the credit balance.

10. The gaming system of claim 9, wherein the processing circuitry is further configured to cause the gaming system to define the one or more block arrangements by defining that the two or more stacks are adjacent in the second direction.

11. The gaming system of claim 9, wherein the processing circuitry is further configured to cause the gaming system to define that the two or more stacks include at least one stack that is not adjacent with another stack of the two or more stacks.

12. The gaming system of claim 11, wherein the processing circuitry is further configured to cause the gaming system to present on the game display an animation of the two or more stacks moving together to form a block of the matching symbols that are adjacent in both the first direction and the second direction.

13. The gaming system of claim 9, wherein the processing circuitry is further configured to cause the gaming system to further determine the game outcome prior to determining one or more winning blocks by:

determining a matching reel as a reel that has stopped wherein all display positions on the matching reel include a matching symbol as a reel matched symbol; and on a next reel adjacent to the matching reel, transforming symbols that are transformation eligible symbols to the reel matched symbol.

14. The gaming system of claim 9, wherein the processing circuitry is further configured to cause the gaming system to define that the one or more block arrangements comprise one or more of a three-by-three block arrangement, a three-by-four block arrangement, and a three-by-five block arrangement.

15. The gaming system of claim 9, wherein the gaming system comprises one or more gaming servers and a user device including the game display and in communication with the one or more gaming servers through a network, wherein the processing circuitry comprises:

first processing circuitry on the user device for performing the act of displaying the electronic reel simulation on the game display; and second processing circuitry on the one or more gaming servers for performing the acts of determining the game outcome, defining the one or more block arrangements, determining the winning combinations, and determining the one or more winning blocks.

16. The gaming system of claim 9, wherein the gaming system is a stand-alone gaming machine and the processing circuitry comprises:

a memory for holding computing instructions; and one or more processors for executing the computing instructions to cause the gaming machine to perform the acts of displaying the electronic reel simulation, determining the game outcome, defining the one or more block arrangements, determining the winning combinations, and determining the one or more winning blocks.

17. A computer implemented method of administering game play on a gaming machine primarily dedicated to playing at least one wagering game, the gaming machine including processing circuitry, a game display, and one or more electronic input devices, the method comprising:

detecting, via at least one of the one or more electronic input devices, a physical item associated with a monetary value that establishes a credit balance;

displaying an electronic reel simulation of the at least one wagering game on the game display of the gaming machine, the electronic reel simulation including a multiple reel array;

determining, using the processing circuitry, a game outcome and causing the game outcome to be presented on the game display, the game outcome comprising a plurality of symbols for an array of displayed positions of the multiple reel array;

randomly applying one or more stack frames to at least one reel of the multiple reel array using the processing circuitry, wherein each stack frame comprises three or more matching symbols that appear in adjacent symbol positions on the at least one reel independently of symbols that appear in other symbol positions of the multiple reel array;

determining, using the processing circuitry, if a winning combination results for the game outcome, wherein the winning combination comprises three or more reels of matching symbols appearing in the displayed positions according to payout ways rules; and triggering a jackpot award responsive to the winning combination including the one or more stack frames within one or more block arrangements defined prior to game play to be evaluated according to block pay rules that are different than the payout ways rules, wherein a size of a payout for the jackpot award depends, at least in part, on a size of the winning block determined by the processing circuitry.

18. The method of claim 17, wherein applying the one or more stack frames further comprises displaying a border around the three or more matching symbols that appear in adjacent symbol positions on the at least one reel.

19. The method of claim 17, further comprising:

defining, before a game play and without player input, the one or more block arrangements, wherein each block arrangement comprises two or more stacks of a same size within the array, each stack comprises two or more adjacent positions along a first direction within the array, each stack occupies a different position within the array in a second direction perpendicular to the first direction, and all of the two or more stacks are aligned in the first direction; and determining one or more winning blocks, wherein each of the one or more winning blocks comprise matching symbols appearing in displayed positions corresponding with the one or more block arrangements.

20. The method of claim 19, wherein defining the one or more block arrangements further comprises defining that the two or more stacks are adjacent in the second direction.

21. The method of claim 19, wherein defining the one or more block arrangements further comprises defining that the two or more stacks include at least one stack that is not adjacent with another stack of the two or more stacks.

22. The method of claim 21, wherein determining the one or more winning blocks further comprises presenting on the game display an animation of the two or more stacks moving together to form a block of the matching symbols that are adjacent in both the first direction and the second direction.

23. The method of claim 19, wherein determining the game outcome further comprises, prior to determining one or more winning blocks:

determining a matching reel as a reel that has stopped wherein all display positions on the matching reel include a matching symbol as a reel matched symbol; and on a next reel adjacent to the matching reel, transforming symbols that are transformation eligible symbols to the reel matched symbol.

24. The method of claim 19, wherein defining the one or more block arrangements comprises defining one or more of a three-by-three block arrangement, a three-by-four block arrangement, and a three-by-five block arrangement.

25. The method of claim 24, wherein triggering the jackpot award further comprises triggering the jackpot award when the one or more stack frames are within the three-by-three block, triggering a larger jackpot award when the one or more stack frames are within the three-by-four block, and triggering a still larger jackpot award when the one or more stack frames are within the three-by-five block.

26. The method of claim 17, wherein:

displaying the electronic reel simulation on the game display is performed by a user device including the game display; and the acts of determining the game outcome, applying the one or more stack frames, determining the winning combinations, and triggering the jackpot award are performed by one or more gaming servers in communication with the user device through a network.

27. The method of claim 17, wherein the operations are performed on a stand-alone gaming machine.

28. A gaming machine primarily dedicated to playing at least one wagering game, the gaming machine comprising:

a cabinet;

a game display coupled to the cabinet; one or more electronic input devices coupled to the cabinet; and processing circuitry operably coupled to the game display and configured to cause the gaming machine to:

detect, via at least one of the one or more electronic input devices, a physical item associated with a monetary value that establishes a credit balance;

initiate the casino wagering game in response to an input indicative of a wager covered by the credit balance;

display an electronic reel simulation of a wagering game on the game display, the electronic reel simulation including a multiple reel array;

determine a game outcome and cause the game outcome to be presented on the game display, the game outcome comprising a plurality of symbols for an array of displayed positions of the multiple reel array;

randomly apply one or more stack frames to at least one reel of the multiple reel array, wherein each stack frame comprises three or more matching symbols that appear in adjacent symbol positions on the at least one reel;

determine one or more winning combinations for the game outcome, wherein the winning combinations comprise three or more reels of matching symbols appearing in the displayed positions according to payout ways rules;

trigger a jackpot award for the one or more stack frames according to block pay rules that are defined prior to game play for independently generated symbols of the one or more stack frames to be evaluated different than the payout ways rules, wherein a size of a payout for the jackpot award depends, at least in part, on a size of the winning combinations determined by the processing circuitry; and receive, via at least one of the one or more electronic input devices, a cashout input that initiates a payout from the credit balance.

29. The gaming machine of claim 28, wherein the processing circuitry is further configured to cause the gaming system to display a border around the three or more matching symbols that appear in adjacent symbol positions on the at least one reel.

30. The gaming machine of claim 28, wherein the processing circuitry is further configured to cause the gaming system to:

define, before the game play and without player input, one or more block arrangements, wherein each block arrangement comprises two or more stacks of a same size within the array, each stack comprises two or more adjacent positions along a first direction within the array, each stack occupies a different position within the array in a second direction perpendicular to the first direction, and all of the two or more stacks are aligned in the first direction; and determine one or more winning blocks, wherein each of the one or more winning blocks comprise matching symbols appearing in displayed positions corresponding with the one or more block arrangements.

31. The gaming machine of claim 30, wherein the processing circuitry is further configured to cause the gaming system to define the one or more block arrangements by defining that the two or more stacks are adjacent in the second direction.

32. The gaming machine of claim 30, wherein the processing circuitry is further configured to cause the gaming system to define that the two or more stacks include at least one stack that is not adjacent with another stack of the two or more stacks.

33. The gaming machine of claim 32, wherein the processing circuitry is further configured to cause the gaming system to present on the display an animation of the two or more stacks moving together to form a block of the matching symbols that are adjacent in both the first direction and the second direction.

34. The gaming machine of claim 30, wherein the processing circuitry is further configured to cause the gaming system to further determine the game outcome prior to determining one or more winning blocks by:

determining a matching reel as a reel that has stopped wherein all display positions on the matching reel include a matching symbol as a reel matched symbol; and on a next reel adjacent to the matching reel, transforming symbols that are transformation eligible symbols to the reel matched symbol.

35. The gaming machine of claim 30, wherein the processing circuitry is further configured to cause the gaming system to define that the one or more block arrangements comprise one or more of a three-by-three block arrangement, a three-by-four block arrangement, and a three-by-five block arrangement.

36. The gaming machine of claim 35, wherein the processing circuitry is further configured to cause the gaming system to trigger the jackpot award when the one or more stack frames are within the three-by-three block, triggering a larger jackpot award when the one or more stack frames are within the three-by-four block, and triggering a still larger jackpot award when the one or more stack frames are within the three-by-five block.

37. The gaming machine of claim 28, wherein the gaming system comprises one or more gaming servers and a user device including the game display and in communication with the one or more gaming servers through a network, wherein the processing circuitry comprises:

first processing circuitry on the user device for performing the act of displaying the electronic reel simulation on the game display; and second processing circuitry on the one or more gaming servers for performing the acts of determining the game outcome, randomly applying the one or more stack frames, determining the one or more winning combinations, and triggering the jackpot award.

38. The gaming machine of claim 28, wherein the gaming system is a stand-alone gaming machine and the processing circuitry comprises:

a memory for holding computing instructions; and one or more processors for executing the computing instructions to cause the gaming machine to perform the acts of displaying the electronic reel simulation, determining the game outcome, randomly applying the one or more stack frames, determining the one or more winning combinations, and triggering the jackpot award.

* * * * *